US011845584B2

(12) United States Patent
Daniels et al.

(10) Patent No.: US 11,845,584 B2
(45) Date of Patent: Dec. 19, 2023

(54) PALLET REASSEMBLY SYSTEM

(71) Applicant: Alliance Automation, LLC, Van Wert, OH (US)

(72) Inventors: Jason Daniels, Elida, OH (US); Justin Haverstock, Auburn, IN (US); Josh Foltz, Delaware, OH (US); Ken Randolph, Perrysburg, OH (US); Benjamin J. Zellers, Sylvania, OH (US); Browning Sheehan, Ft Wayne, IN (US)

(73) Assignee: ALLIANCE AUTOMATION, LLC, Van Wert, OH (US)

( * ) Notice: Subject to any disclaimer, the term of this patent is extended or adjusted under 35 U.S.C. 154(b) by 59 days.

(21) Appl. No.: 17/655,123

(22) Filed: Mar. 16, 2022

(65) Prior Publication Data

US 2022/0297884 A1 Sep. 22, 2022

Related U.S. Application Data

(60) Provisional application No. 63/161,717, filed on Mar. 16, 2021.

(51) Int. Cl.
*B65D 19/00* (2006.01)
*B65D 19/38* (2006.01)

(52) U.S. Cl.
CPC ..... *B65D 19/0073* (2013.01); *B65D 19/002* (2013.01); *B65D 19/0095* (2013.01); *B65D 19/38* (2013.01); *B65D 2519/0099* (2013.01); *B65D 2519/00104* (2013.01); *B65D 2519/00273* (2013.01); *B65D 2519/00288* (2013.01); *B65D 2519/00293* (2013.01); *B65D 2519/00323* (2013.01); *B65D 2519/00333* (2013.01); *B65D 2519/00338* (2013.01); *B65D 2519/00373* (2013.01); *B65D 2519/00398* (2013.01); *B65D 2519/00437* (2013.01); *B65D 2519/00552* (2013.01); *B65D 2519/00567* (2013.01)

(58) Field of Classification Search
CPC .. B65D 19/38; B65D 19/002; B65D 19/0073; B65D 19/0095; B65D 2519/0099
USPC ..... 108/51.3, 51.11; 29/430, 200, 208; 493/334
See application file for complete search history.

(56) References Cited

U.S. PATENT DOCUMENTS 3,968,560 A * 7/1976 Vial ..... B27M 3/0073 29/430
4,743,154 A * 5/1988 James ..... B23P 19/041 29/721

(Continued)

FOREIGN PATENT DOCUMENTS

EP 2082827 A2 * 7/2009 ..... B23P 19/041

*Primary Examiner* — Jose V Chen
(74) *Attorney, Agent, or Firm* — Shumaker, Loop & Kendrick, LLP; James D. Miller

(57) ABSTRACT

A pallet reassembly system includes at least one block installation mechanism configured to install a block within a partially assembled pallet, at least one board installation mechanism configured to install a board within the partially assembled pallet, and at least one transport assembly for transporting the partially assembled pallet to each of the at least one block installation mechanisms and each of the at least one board installation mechanisms. The transport assemblies are arranged into a loop including at least two perpendicular arranged legs.

19 Claims, 19 Drawing Sheets

(56) References Cited

U.S. PATENT DOCUMENTS

| | | | | |
|---|---|---|---|---|
| 5,201,110 | A * | 4/1993 | Bane | B23D 53/02 83/788 |
| 5,413,662 | A * | 5/1995 | Skinner, III | B32B 38/1808 156/266 |
| 6,058,586 | A * | 5/2000 | Bowling | B23P 19/041 29/402.11 |
| 6,687,970 | B2 * | 2/2004 | Waechter | B23P 19/041 83/705 |
| 6,763,567 | B2 * | 7/2004 | Smith | B27M 3/0073 29/430 |
| 6,829,822 | B1 * | 12/2004 | Minick | B23P 19/041 29/772 |
| 7,117,586 | B2 * | 10/2006 | Dykstra | B23P 19/041 29/772 |
| 7,954,240 | B2 * | 6/2011 | Holliger | B27M 3/0073 29/402.06 |
| 8,266,790 | B2 * | 9/2012 | Townsend | B23P 19/041 29/772 |
| 8,567,324 | B1 * | 10/2013 | Paradis | B65D 19/0012 108/57.25 |
| 8,978,241 | B2 * | 3/2015 | Smith | B23P 19/041 29/244 |
| 9,339,902 | B2 * | 5/2016 | Berg | B23P 19/041 |
| 10,589,943 | B1 * | 3/2020 | Yohe | B65B 35/50 |
| 2007/0113391 | A1 * | 5/2007 | Tykkylainen | B23P 21/004 29/407.09 |
| 2014/0251189 | A1 * | 9/2014 | Takyar | B65D 19/0095 108/57.17 |
| 2020/0283193 | A1 * | 9/2020 | De Laender | B65D 19/0095 |
| 2021/0024250 | A1 * | 1/2021 | Langenbeck | E04C 3/36 |
| 2021/0146577 | A1 * | 5/2021 | Gowdar | B65D 19/0095 |
| 2022/0161966 | A1 * | 5/2022 | Gordon | B65D 19/06 |

* cited by examiner

PALLET REASSEMBLY SYSTEM

CROSS-REFERENCE TO RELATED PATENT APPLICATIONS

This patent application claims priority to U.S. Provisional Patent Application Ser. No. 63/161,717, filed on Mar. 16, 2021, the entire disclosure of which is hereby incorporated herein by reference.

FIELD OF THE INVENTION

The invention relates generally to a system and method for reassembling pallets, and more particularly, to a system and method for reassembling block type pallets by selectively replacing damaged or missing portions of the block pallet using automatic assembly processes.

BACKGROUND

Since the development of the modern forklift in the early part of the twentieth century, the pallet has been relied upon as an efficient means of handling and transporting bulk goods and freight. The pallet is particularly desirable due to its relatively low cost to manufacture, as well as the abundance and renewability of the materials forming such pallets. For example, many pallets are formed from wood. According to the U.S. Forest Service, there are approximately two billion wooden pallets currently in circulation throughout the United States.

While the relative durability of wood makes it a desirable material for pallets, it is subject to deterioration and destruction over extended periods of time. For example, individual boards forming the pallet may rot if continuously exposed to moisture or may be broken during handling. Accordingly, there is a continuous need for new pallets to replace destroyed or expended pallets and fill a growing market demand.

Although wood is a readily available resource, there are a number of factors driving a desire to maximize recovery of pallets, as opposed to continuously manufacturing new pallets. For example, wood used in pallets is typically treated with a preservative chemical in order to minimize decomposition. While effective in extending the life of the pallet, the preservative chemical is toxic, making disposal of pallets harmful to the environment. In addition, despite the renewable nature of wood, the sheer volume of pallets used in the United States has further driven the desire to recover as many pallets as possible in order to minimize cost and consumption.

Often, the inspection of pallets reveals that only some of the components forming the pallet are in need of replacement in order to restore the pallet to a desired state. However, the construction of the pallet may render it difficult to easily access and replace such components due to the layered nature of the components forming the pallet. For example, a block pallet may include a bottom deck formed by a first layer comprised of bottom deck boards, a plurality of blocks disposed on the bottom deck forming a second layer, a plurality of stringer boards extending across the blocks forming a third layer, and a top deck formed by a fourth layer comprising a plurality of top deck boards extending perpendicularly across the stringer boards. These four different layers present multiple overlaps and coupled surfaces that render it difficult to easily replace interior components such as the blocks or the stringer boards without having to remove and/or replace multiple adjacent layers of the pallet to achieve the desired final configuration of the block pallet.

Accordingly, there exists a need in the art for an automated system and method for reassembling a pallet, wherein the system is capable of installing multiple different replacement components of the corresponding pallet forming multiple different layers of the pallet.

The configuration of the described block pallet also requires that the installation process is capable of being performed with respect to components extending around a perimeter of the block pallet as well as each of the two major sides (top and bottom) of the block pallet, thereby requiring the pallet to be addressed from multiple different orientations during the installation of the missing components. The need to address multiple different surfaces of the pallet can result in the need for complex reorientation mechanisms or multiple different component replacement mechanisms in order to accommodate the various different components of the pallet that may need replacement. This can in turn can expand the imprint of any such reassembly system due to the need to constantly transport the pallet from mechanism to mechanism in order to address the various missing components. Additionally, the need to address multiple different components of the pallet can further result in the need for various mechanisms of the reassembly system to be repeated multiple times along the manufacturing process, thereby significantly increasing tooling costs.

Accordingly, there further exists a need in the art for an automated system and method for reassembling a pallet, wherein the automated system is further configured to repeatedly perform the installation process with respect to different components of the pallet within a restricted space, wherein the automated system includes a loop having means for reorienting the pallet each time it is passed through the loop in order to address multiple different components of the pallet with limited tooling resources.

SUMMARY

In concordance with the instant disclosure, an automated system and method for reassembling pallets is disclosed.

According to an embodiment of the present invention, a pallet reassembly system comprises at least one block installation mechanism configured to install a block within a partially assembled pallet, at least one board installation mechanism configured to install a board within the partially assembled pallet, and at least one transport assembly for transporting the partially assembled pallet to each of the at least one block installation mechanisms and each of the at least one board installation mechanisms.

According to another embodiment of the present invention, a block installation mechanism comprises a block magazine for storing at least one block, a board spreader configured to increase a height of a gap within a partially assembled pallet, and a block pusher configured to push the block into the gap within the partially assembled pallet.

According to another embodiment of the present invention, a board installation mechanism comprises a block magazine for storing at least one board and a board pusher configured to load a board and install the board into a partially assembled pallet.

BRIEF DESCRIPTION OF THE DRAWINGS

The above, as well as other objects and advantages of the invention, will become readily apparent to those skilled in the art from reading the following detailed description of a preferred embodiment of the invention when considered in the light of the accompanying drawings.

DETAILED DESCRIPTION OF THE INVENTION

Figure 1:
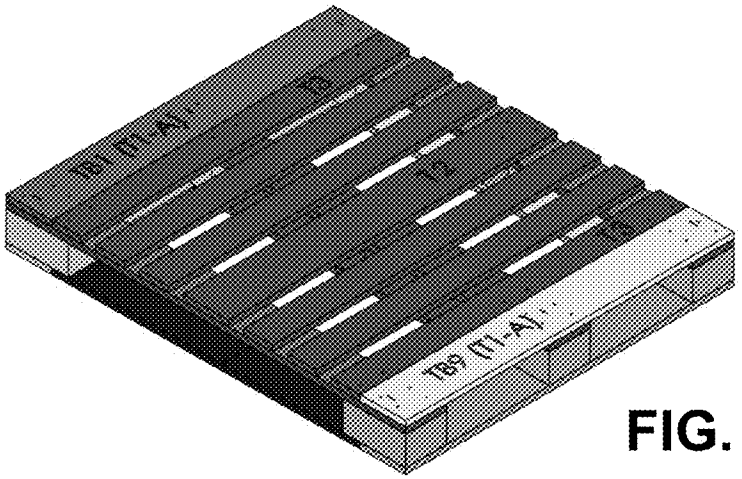
FIGS. 1 and 2 are perspective views showing the configuration of a pallet suitable for use with the pallet reassembly system of the present invention.

The following detailed description and appended drawings describe and illustrate various embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical. As used herein, the term "substantially" means approximate to or almost.

The present invention relates to a reassembly system 10 for the reassembling of pallets according to an embodiment of the present invention. More specifically, the reassembly system 10 is configured to install a variety of different components at desired locations within a partially assembled pallet to complete the configuration of the pallet for commercial use.

The reassembly system 10 may form a portion of a patent maintenance system configured for performing various tasks relating to the disassembly and/or assembly of such pallets. For example, the pallet maintenance system may include stations configured for tasks such as inspecting pallets for damage or missing components, removing those damaged components in need of replacement, and identifying and cataloguing those components that will need to be installed into the partially assembled pallet following the removal of any damaged components. These tasks may be performed prior to the pallets reaching the reassembly system 10, wherein only those pallets suitable for reassembly within the reassembly system 10 are delivered thereto via the sorting of the pallets upstream of the reassembly system 10. For example, those pallets devoid of missing or damaged components or those pallets damaged beyond repair may bypass the reassembly system 10. The upstream sorting of the pallets as well as the identification of the components in need of replacement may be performed by a human operator or may be performed by a suitable sensor system (not shown) or the like capable of identifying potential problems such as missing components or badly damaged components.

Regardless of the method of identification, a controller (not shown) responsible for operation of the reassembly system 10 is made aware of the components of the pallet in need of replacement following the inspection and removal processes, whether by the determination of corresponding sensors or the entry of data by a human operator. Although not pictured, the controller is representative of any computational device having the necessary processing capabilities, memory, and preprogrammed instruction sets for carrying out the functions described herein, as well as the ability to send and receive control signals associated with the operation of the reassembly system 10. As such, it is assumed that the controller is in signal communication with each relevant component of the reassembly system 10 that is not described as being manually performed by a human operator. The signal communication may be direct or wireless, as desired. References hereinafter to the automatic operation or signal-generated response of any component is assumed to be initiated by the controller when not specifically described as such. The controller as described may also be representative of multiple different controllers or the like in signal communication with each other, as desired, without departing from the scope of the present invention, so long as the controllers are capable of communicating and interpreting the control signals as described hereinafter.

The reassembly system 10 as shown and described is representative of only one possible configuration of the reassembly system 10. As is explained in detail hereinafter, the reassembly system 10 includes multiple different stations that are configured to address the replacement of different components of the pallets in need of reassembly, hence the reassembly system 10 may be configured to only include those stations associated with the installation of certain combinations of the components forming the pallets. That is, the versatility of the reassembly system 10 may be modified by adding or removing stations that are associated with replacing only certain components of the pallets in accordance with the typical conditions experienced following the inspection of the pallets prior to entry into the reassembly system 10. For example, the reassembly system 10 may in certain circumstances be configured to only address certain components of the pallet that are repeatedly damaged or missing, thereby removing the need for certain stations that address the rarely damaged or missing components of the pallet.

The reassembly system 10 is shown and described with reference to various different steps that can be performed on a partially assembled pallet that is initially provided with a minimum number of components necessary for the partially assembled pallet to be operable with the reassembly system 10, wherein the steps take the exemplary partially assembled pallet from the minimum number of possible components to a completed configuration. It should be readily apparent to one skilled in the art that the reassembly system 10 is not limited to this full reassembly process, but may instead be initiated with respect to any of the different configurations of the partially assembled pallet illustrated herein as additional components are added thereto. It should also be apparent that the steps preceding the partially assembled pallet reaching any such illustrated configuration may be omitted from the corresponding process, and only those remaining steps must be utilized. In other words, the reassembly system 10 is capable of reassembling a completed pallet starting from any of the illustrated configurations of the partially assembled pallets shown herein, even with respect to those steps that are described as intermediary steps with respect to the reassembly of the partially assembled pallet starting from the initial configuration having the minimal number of components. Lastly, it should also be apparent that many of the steps shown and described herein may also be performed with respect to configurations of the pallet that are not necessarily shown. For example, the installation of certain boards, blocks, and stringers requires the reassembly system 10 to interact with only certain components of the pallet. As such, in some circumstances these steps can be performed regardless of the presence of certain remotely disposed components of the pallet. It should be apparent from the description of each step which of the components of the pallet are required to be present to initiate the placement of any other specific component.

The reassembly system 10 as shown and described hereinafter is configured for use with a type of pallet known as the "block pallet," wherein rectangular cuboid blocks are utilized for spacing the opposing top and bottom decks of the block pallet. However, it should be apparent to one skilled in the art that the present invention may be adapted for use with different pallet configurations where similar circumstances are present regarding the relationships between the components forming the pallets. For example, if a pallet having spacing stringers rather than blocks is utilized, similar processes may still be used for installing various components of the pallet such as the top deck boards and the bottom deck boards thereof via suitable adaptations to the reassembly system 10, as one non-limiting example.

The block pallets as described herein generally include a rectangular perimeter shape with two opposing long sides and two opposing short sides. As illustrated, the long sides are assumed to be 48" long and the narrow sides are assumed to be 40" long, but it should be readily apparent to one skilled in the art that the present invention may be adapted for use with block pallets having substantially any dimensions without departing from the scope of the present invention. As used herein, the longitudinal direction of the pallet refers to the direction of extension of the long sides thereof while the width direction of the pallet refers to the direction of extension of the short sides thereof. A height direction of the pallet refers to the direction perpendicular to each of the longitudinal direction and the width direction.

Figure 2:
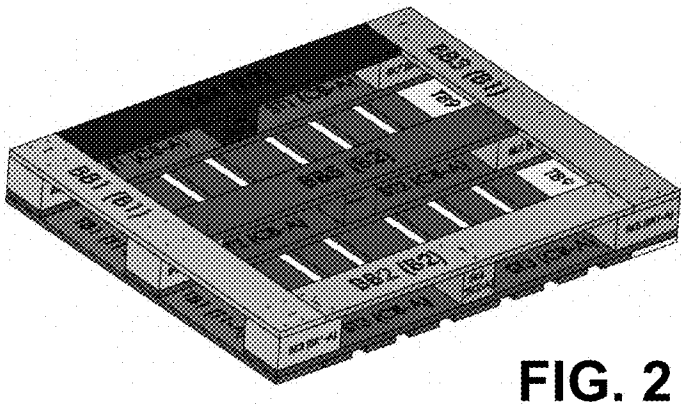

FIGS. 1 and 2 illustrate a configuration of an exemplary block pallet suitable for use with the reassembly system 10. The pallet is generally comprised of four stacked layers. The layers include a bottom deck comprising a plurality of bottom deck boards BB1, BB2, BB3, BB4, BB5, a block layer comprising a plurality of blocks BK1, BK2, BK3, BK4, BK5, BK6, BK7, BK8, BK9 disposed on the bottom deck, a stringer layer comprising a plurality of stringers ST1, ST2, ST3 stacked on the block layer, and a top deck comprising a plurality of top deck boards TB1, TB2, TB3, TB4, TB5, TB6, TB7, TB8, TB9 stacked on top of the stringer layer.

The bottom deck includes the boards BB1 and BB3 disposed at opposing longitudinal ends of the pallet with the boards BB1 and BB3 extending longitudinally in the width direction of the pallet. The remaining bottom deck boards BB2, BB4, and BB5 extend longitudinally in the longitudinal direction of the pallet with the boards BB2, BB4, BB5 spanning a gap present between the spaced apart boards BB1 and BB3. The board BB2 extends along one longitudinal side of the pallet while the board BB4 extends along the other oppositely arranged longitudinal side of the pallet. The board BB5 is disposed between and equally spaced from each of the boards BB4 and BB2.

The block layer includes each of the blocks BK1, BK2, BK3, BK4, BK5, BK6, BK7, BK8, BK9 having the same height to equally space the bottom deck boards BB1, BB2, BB3, BB4, BB5 from the stringers ST1, ST2, ST3 with respect to the height direction. The blocks BK1, BK2, BK3, BK5, BK6, BK7 disposed along the short sides of the pallet are each elongated in the longitudinal direction of the pallet to cause each of the elongated blocks BK1, BK2, BK3, BK5, BK6, BK7 to span one of the joints present between one of the bottom deck boards BB1, BB3 extending in the width direction of the pallet and a corresponding one of the bottom deck boards BB2, BB4, BB5 extending in the longitudinal direction of the pallet. The blocks BK4, BK8, BK9 are spaced equally from the opposing longitudinal ends of the pallet with each of the blocks Bk4, BK8, BK9 disposed between one of the bottom deck boards BB2, BB4, BB5 and a corresponding one of the stringers ST1, ST2, ST3. Each of the blocks BK1, BK2, BK3, BK4, BK5, BK6, BK7, BK8, BK9 includes a common width that matches a width of each of the adjoining bottom deck boards BB1, BB2, BB3, BB4, BB5 as well as each of the adjoining stringers ST1, ST2, ST3.

The stringer layer includes each of the stringers ST1, ST2, ST3 extending longitudinally across an entire length of the pallet. The stringer ST1 extends along one lateral side of the pallet and engages each of blocks BK1, BK7, and BK8. The stringer ST2 extends along a central longitudinal axis of the pallet and engages each of blocks BK2, BK6, and BK9. The stringer ST3 extends along another lateral side of the pallet and engages each of blocks BK3, BK4, and BK5.

The top deck includes each of the top deck boards TB1, TB2, TB3, TB4, TB5, TB6, TB7, TB8, TB9 extending longitudinally across an entirety of the width dimension of the block pallet with each of the top deck boards TB1, TB2, TB3, TB4, TB5, TB6, TB7, TB8, TB9 engaging each of the three stringers ST1, ST2, ST3. The top deck boards TB1 and TB9 are disposed along opposing short sides of the pallet and may alternatively be referred to as the leading deck boards of the pallet.

The various boards, blocks, and stringers forming the pallet may be coupled to one another using any form of suitable coupling method, including but not limited to the use of fasteners such as staples or nails, as non-limiting examples.

The controller of the reassembly system 10 is configured to receive information regarding the dimensions and configuration of the pallets to be reassembled or is preprogrammed to know the dimensions and configurations of the pallets to be reassembled. The controller is also preprogrammed to be aware of the relative dimensions between the various components of the reassembly system 10, hence identification of the position and orientation of any known surface of the pallet being reassembled may be utilized in determining the relative position between any other portion or surface of the partially reassembled pallet and any other component of the reassembly system 10. For example, when positioning the partially reassembled pallet for the installation of a missing component, the known position and orientation of a leading surface of the partially reassembled pallet may be utilized to determine the relative positioning between any spaced apart surfaces of the partially reassembled pallet and any spaced apart mechanisms of the reassembly system 10 via reference to the known spatial relationships present therebetween.

Figure 3:
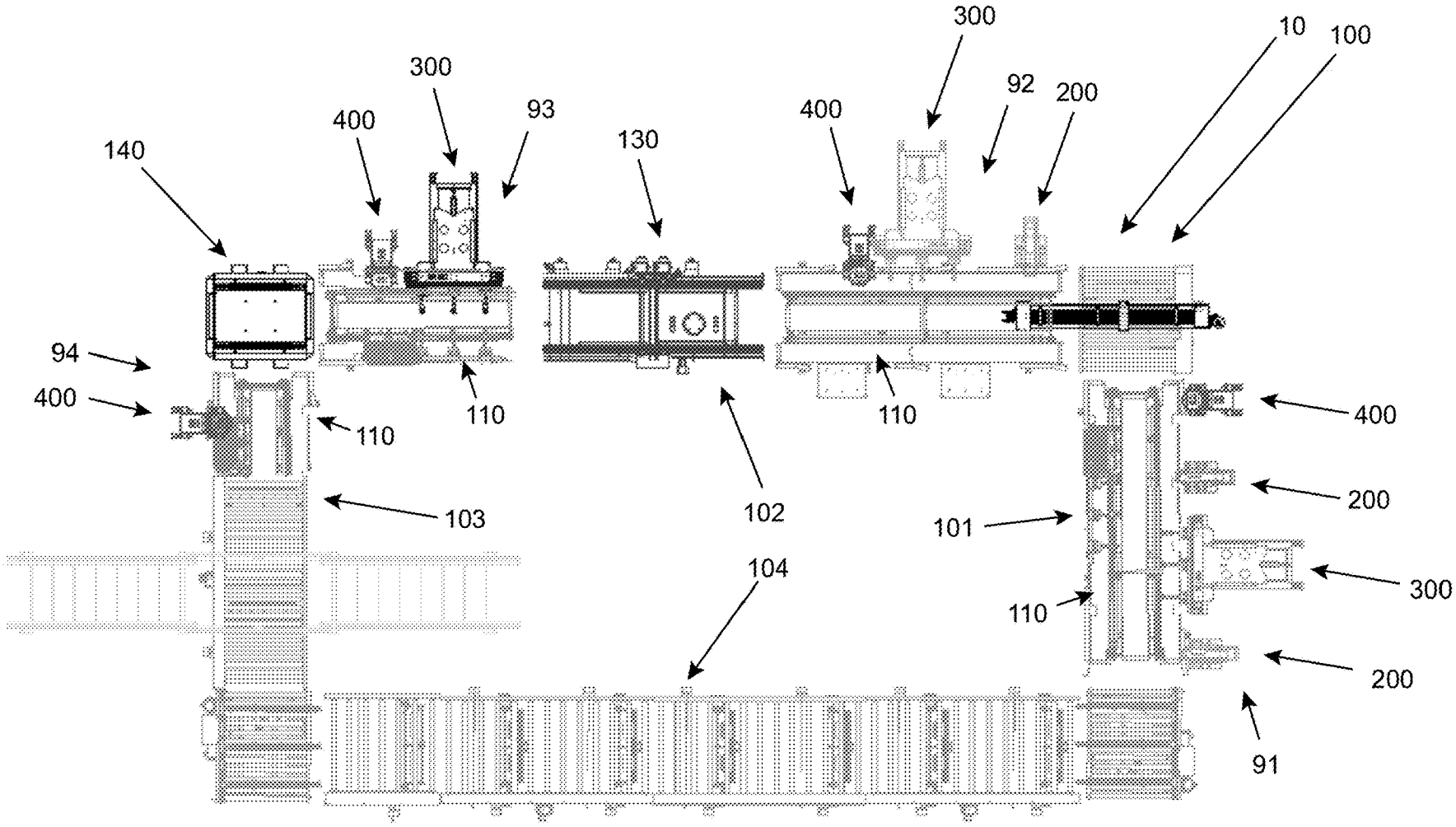
FIG. 3 is a top schematic view of an embodiment of the pallet reassembly system.

Referring now to FIG. 3, one representative example of the reassembly system 10 is disclosed according to an embodiment of the invention. The reassembly system 10 is configured to transport a partially assembled pallet around a loop 100 at least one time (lap) in order to perform at least one installation step relative to the corresponding partially assembled pallet. The loop 100 is generally rectangular in configuration and includes a first leg 101, a second leg 102, a third leg 103, and a fourth leg 104, wherein each of the legs 101, 102, 103, 104 forms one rectilinear side of the rectangular shaped loop 100. A corner of the loop 100 forming the beginning of the first leg 101 and the end of the fourth leg 104 may represent an origin of the reassembly process wherein partially assembled pallets are first introduced into the reassembly system 10. The partially assembled pallets are configured to move around the loop 100 in a counterclockwise direction from the perspective of FIG. 3, wherein the partially assembled pallet traverses the legs 101, 102, 103, 104 in the order of numbering thereof.

Figure 5:
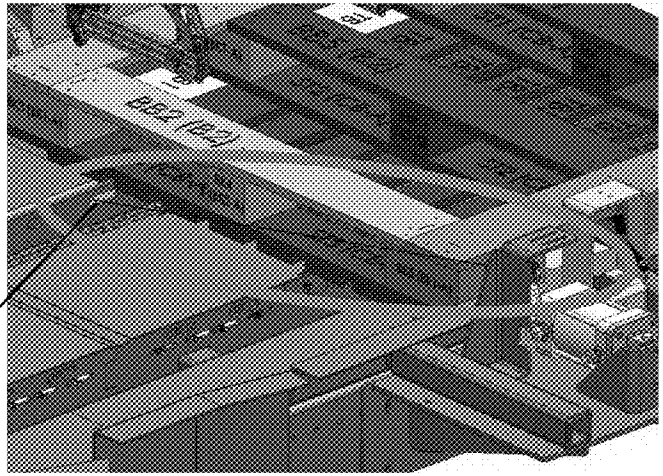
FIGS. 4-6 are perspective views of a conveyor assembly of the pallet reassembly system.
Figure 4:
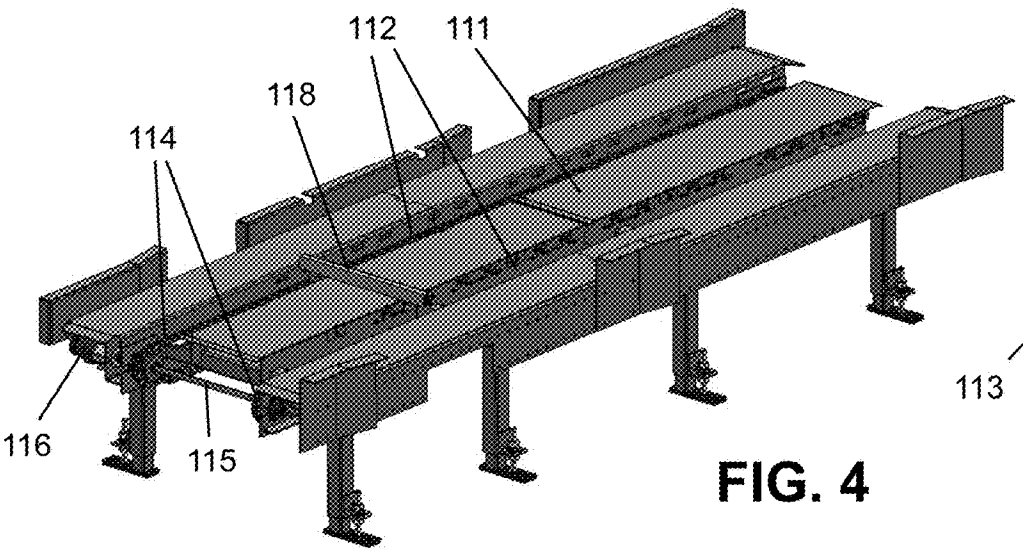
Figure 6:
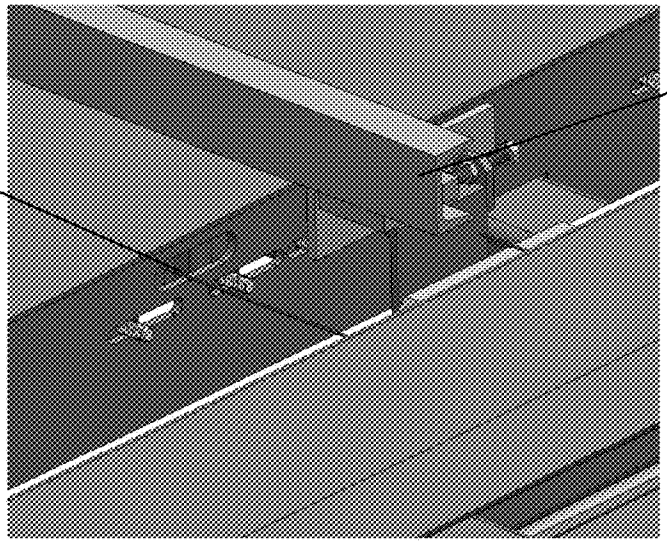

Referring now to FIGS. 4-6, a drag chain conveyor assembly 110 may be utilized for transporting the partially assembled pallet along any of the described rectilinear legs 101, 102, 103, 104 of the loop 100 in the disclosed direction of travel. The drag chain conveyor assembly 110 includes a skid plate 111 surrounded by a pair of openings 112. Each of the side surfaces of the skid plate 111 partially defining the openings 112 includes at least one position sensor 113 disposed thereon. Each of the openings 112 also includes a chain belt 114 looped therein with each of the opposing ends of the loop formed by the chain belt 114 engaging an axel 115. At least one of the axels 115 is driven by an actuator 116, such as a hydraulic actuator. A push bar 118 is coupled to and configured to move in unison with each of the pair of the chain belts 114 straddling the skid plate 111. The push bar 118 is configured to engage one of the side surfaces of the partially assembled pallet when traversing each of the drag chain conveyor assemblies 110 in order to push the partially assembly pallet along the skid plate 111.

Each of the at least one position sensors 113 is disposed at a location on the corresponding drag chain conveyor assembly 110 corresponding to a stop position for the partially assembled pallet to allow for the installation or coupling together of one or more of the components forming the completed pallet. In some circumstances, as shown in FIG. 5, the at least one position sensor 113 is configured to monitor and determine when a leading edge or surface of the partially assembled pallet has first reached the location of the at least one position sensor 113 with respect to the longitudinal direction of the corresponding leg 101, 102, 103, 104 of the loop 100, such as by reading the leading surface of one of the blocks BK1, BK2, BK3, BK4, BK5, BK6, BK7, BK8 when forming a portion of the leading edge or surface of the partially assembled pallet. In other circumstances, as shown in FIG. 6, the at least one position sensor 113 may be configured to monitor and determine when a surface of the push bar 118 has first reached the location of the at least one position sensor 113 with respect to the longitudinal direction of the corresponding leg 101, 102, 103, 104 of the loop 100, thereby effectively measuring a position of the trailing edge or surface of the partially assembled pallet due to the manner in which the push bar 118 engages this trailing edge or surface. The drag chain conveyor assembly 110 is accordingly configured to transport the partially assembled pallet along each of the legs 101, 102, 103, 104 unless and until one of the position sensors 113 associated with that leg 101, 102, 103, 104 determines that the partially assembled pallet must be stopped to perform one of the process steps as described in greater detail hereinafter.

The drag chain conveyor assembly 110 is only one representative example of a rectilinear transport mechanism suitable for transporting the partially assembled pallets in the manner described herein, and may be replaced with any other suitable rectilinear transport mechanism, including other forms of conveyer belts, roller assemblies, or the like, without departing from the scope of the present invention. The detection of the position of the partially assembled pallet may also be accomplished using any desired sensor system configured to monitor for the position of any surface or edge of the partially assembled pallet, so long as the sensed condition is able to be correlated to the position of the partially assembled pallet relative to the performance of any disclosed process step carried out by the reassembly system 10.

Each of the previously mentioned process steps may include the need to further position or orient the corresponding partially assembled pallet with respect to a lateral direction perpendicular to the direction of travel of the partially assembled pallet along the corresponding leg 101, 102, 103, 104 of the loop 100. As such, each of the different mechanisms associated with performing one of the disclosed process steps may be disposed on a side of the corresponding drag chain conveyor assembly 110 disposed opposite a corresponding pallet justification mechanism 120.

Figure 7:
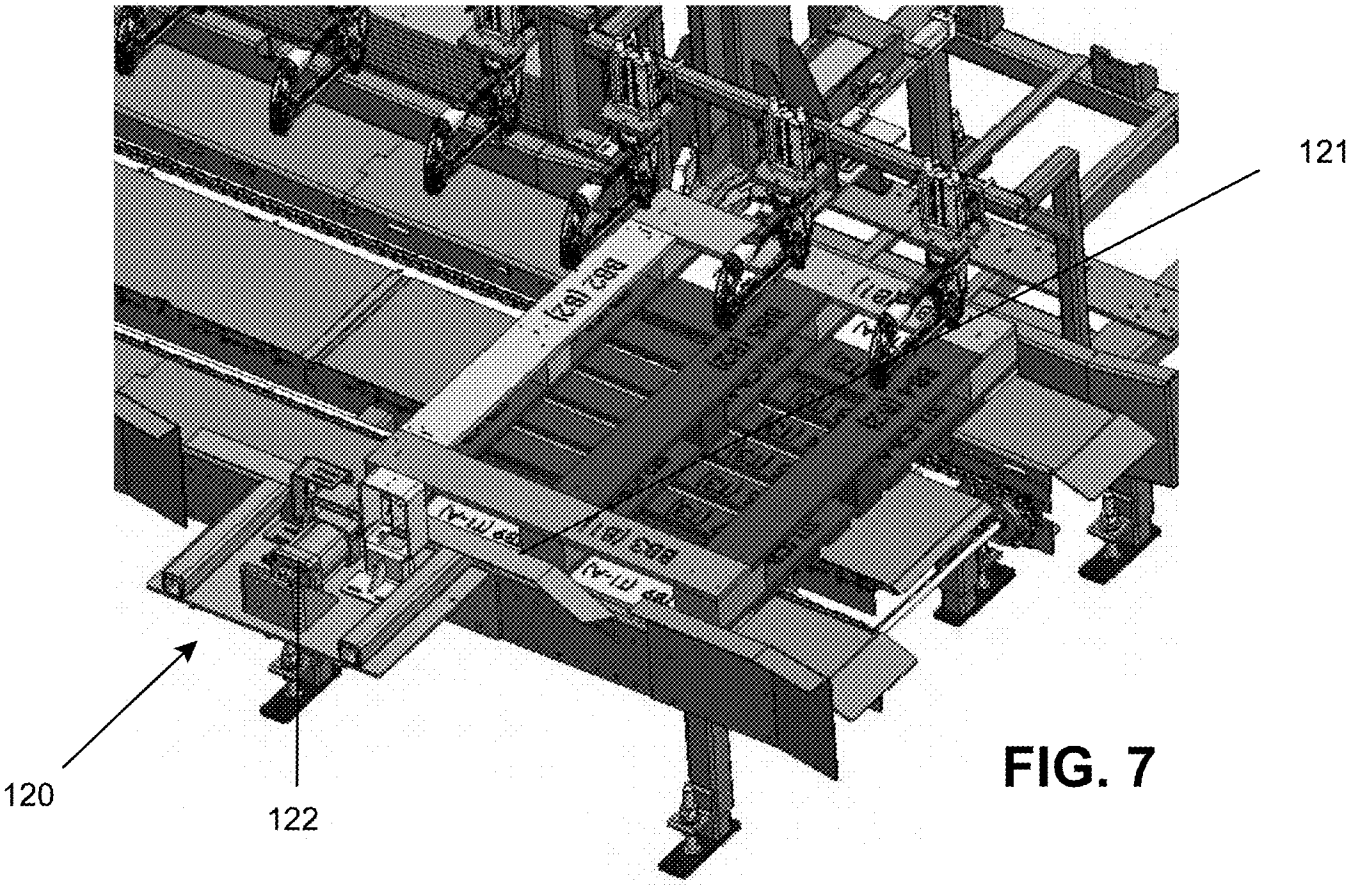
FIG. 7 is a perspective view of a pallet justification mechanism according to an embodiment of the present invention.

As shown in FIG. 7, the pallet justification mechanism 120 includes an engaging surface 121 arranged parallel to the direction of travel of the partially assembled pallet along the corresponding leg 101, 102, 103, 104 of the loop 100. A linear drive actuator 122 of the pallet justification mechanism 120 is configured to move the engaging surface 121 towards and away from the partially assembled pallet with respect to a horizontal direction arranged perpendicular to the direction of travel of the partially assembled pallet along the corresponding leg 101, 102, 103, 104 of the loop 100. The pallet justification mechanism 120 is configured to ensure that the partially assembled pallet is both oriented properly via the removal of any potential skew relative to the direction of travel thereof and positioned in the lateral direction for the desired interaction with whatever mechanisms are performing the instantaneous process step of the reassembly system 10. For example, the pallet justification mechanism 120 may be configured to push the partially assembled pallet until a corresponding side surface thereof engages a desired surface of the mechanism performing the instantaneous process step with the corresponding side surface arranged parallel to the desired direction of travel of the partially assembled pallet along the corresponding leg 101, 102, 103, 104 of the loop 100.

Figure 8:
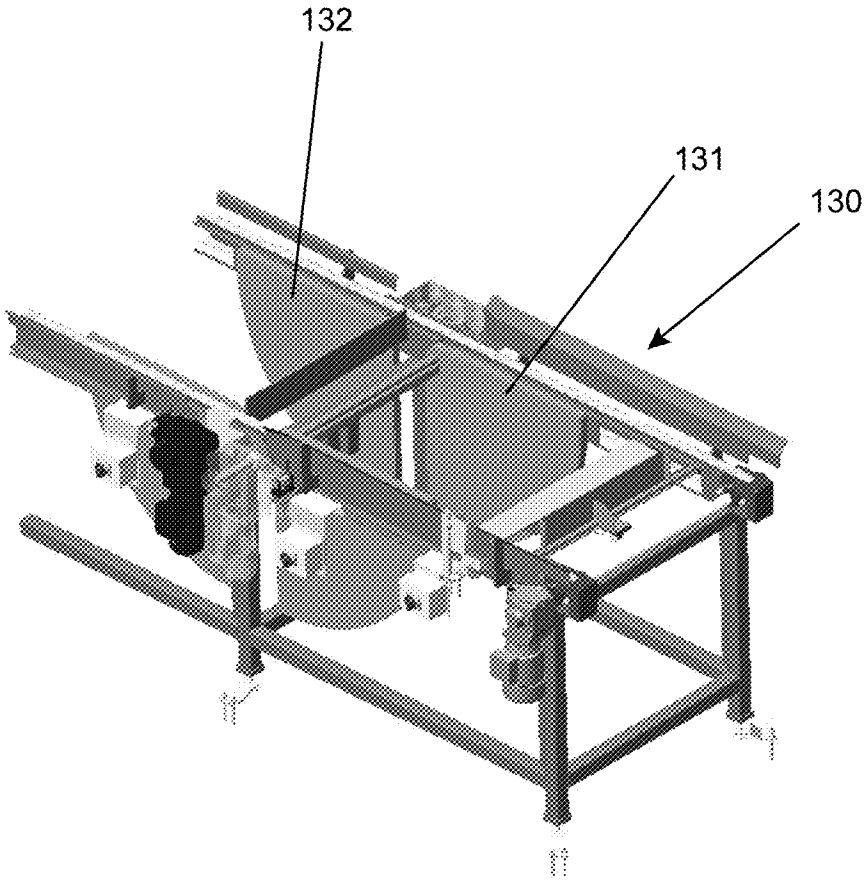
FIG. 8 is a perspective view of a pallet flipping mechanism according to an embodiment of the present invention.
Figure 11:
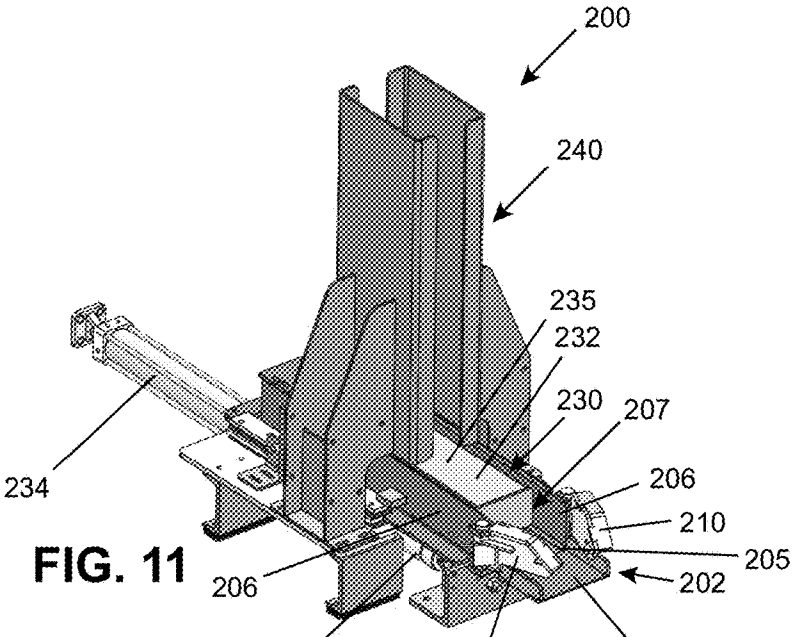
FIGS. 10-13 are perspective views of a block installation device according to an embodiment of the present invention.
Figure 12:
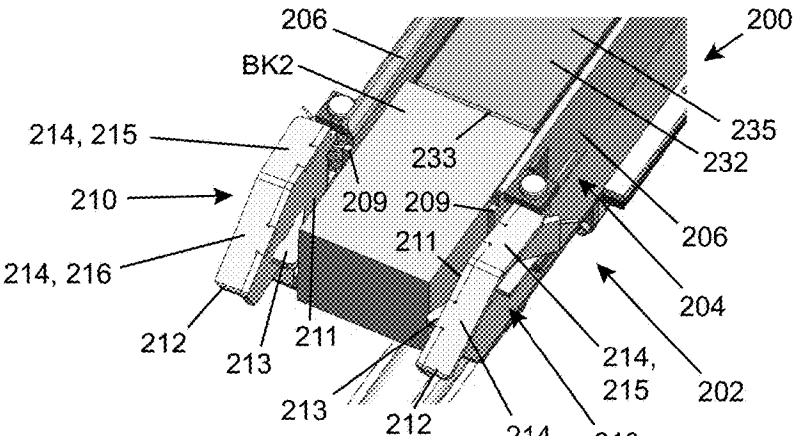
Figure 10:
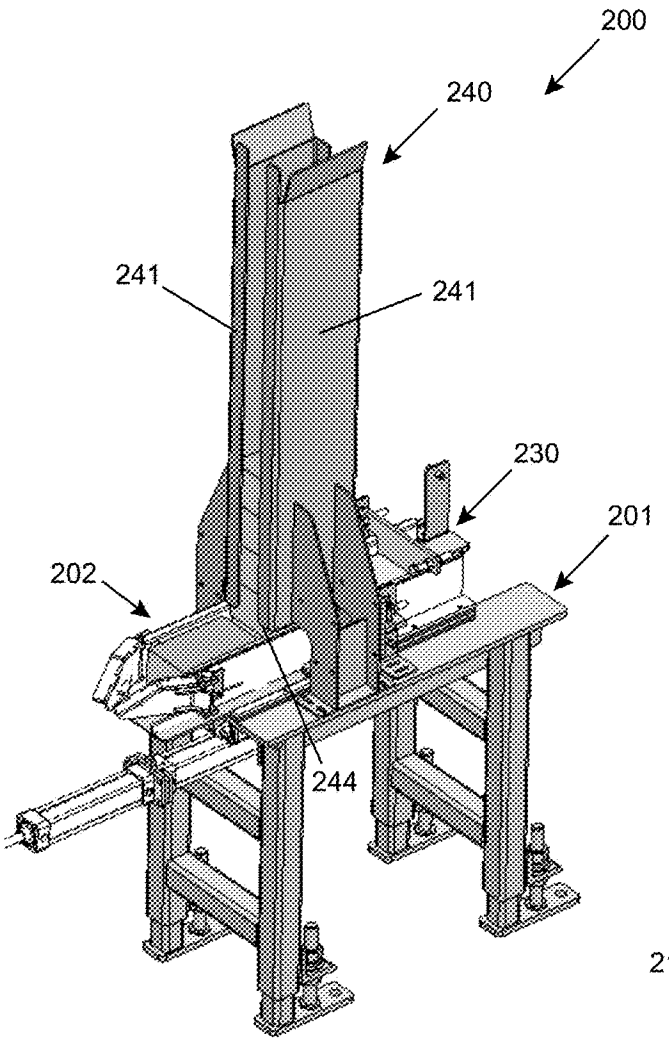

FIG. 8 illustrates a pallet flipping mechanism 130 of the reassembly system 10. The pallet flipping mechanism 130 is configured to rotate the pallet 180 degrees about a horizontally extending axis arranged perpendicular to the direction of travel of the partially assembled pallet along the corresponding leg 101, 102, 103, 104 of the loop 100. The rotation of the partially assembled pallet results in the top deck and the bottom deck switching positions as well as the leading surface and the trailing surface switching positions, thereby reorienting the partially assembled pallet for future process steps. The pallet flipping mechanism 130 is also configured to be a pass-through mechanism, wherein the pallet flipping mechanism 130 can bypass the partially assembled pallet if the next process step to be applied thereto does not require the described flipping of the partially assembled pallet.

The pallet flipping mechanism 130 generally includes a first pivoting element 131 and a second pivoting element 132. The first pivoting element 131 approaches the partially assembled pallet from an underside thereof and pivots in a first pivoting direction to cause the partially assembled pallet to lift up and rotate to a substantially upright position. The second pivoting element 132 pivots upwardly in a second pivoting direction opposite the first pivoting direction to face towards the partially assembled pallet and the first pivoting element 131. The partially assembled pallet is then passed off from the first pivoting element 131 to the second pivoting element 132 to flip the partially assembled pallet in the manner described. The first pivoting element 131 then pivots back to its initial position by pivoting in the second pivoting direction while the second pivoting element 132 also pivots back to its initial position by pivoting in the first pivoting direction. The manner in which the pivoting elements 131, 132 pivot towards each and other and then away from each other during the passing off of the partially assembled pallet may be referred to as a "high-five" motion.

In the present embodiment, the pallet flipping mechanism 130 is disposed along the second leg 102 of the loop 100. However, it should be apparent to one skilled in the art that the pallet flipping mechanism 130 may be disposed at other locations along the loop 100 while remaining within the scope of the present invention, although the order of the process steps described hereinafter may be altered by such a repositioning.

The reassembly system 10 further includes a pallet rotating mechanism 140. The pallet rotating mechanism 140 is configured to selectively rotate the partially assembled pallet 180 degrees about a vertically extending axis in order to reverse the position of each of the side surfaces of the partially assembled pallet. The top deck and the bottom deck of the partially assembled pallet maintain the same general relationship following the 180 degree rotation about the vertical axis.

Figure 9:
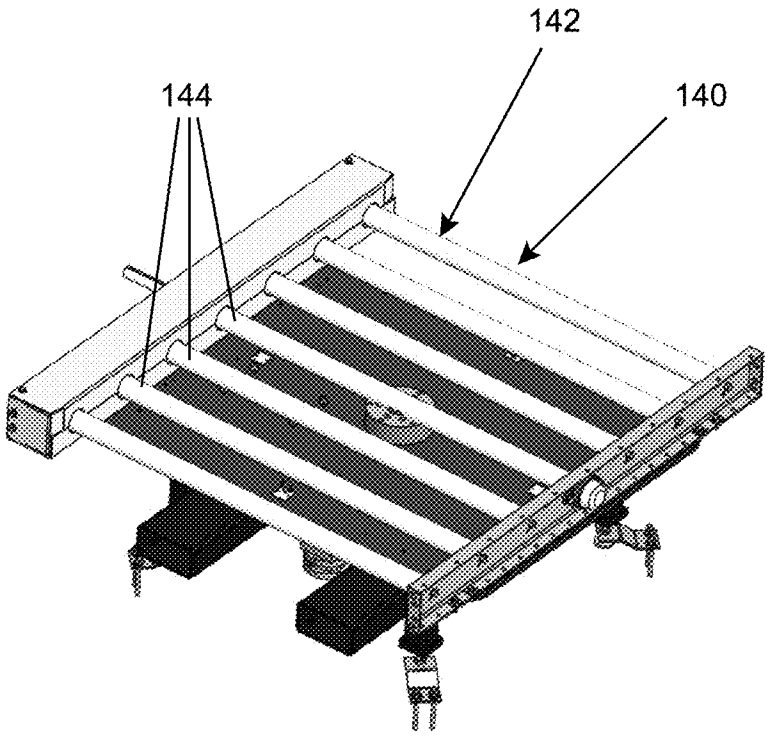
FIG. 9 is a perspective view of a pallet rotating mechanism according to an embodiment of the present invention.

As shown in FIG. 9, the pallet rotating mechanism 140 includes a platform 142 formed by a plurality of rollers 144. Each of the rollers 144 is configured to be selectively rotated to advance the partially assembled pallet along the platform 142 in a direction perpendicular to the direction of extension of the rollers 144. The rollers 144 may be mechanically linked and actuated by a common rotary actuator, as desired. The platform 142 is configured to rotate about a central vertical axis thereof and may be driven by any suitable rotary actuator, as desired.

The pallet rotating mechanism 140 is also configured to be passable without rotating the partially assembled pallet. Instead, the pallet rotating mechanism 140 activates the rollers 144 without first performing the 180 degree rotation, thereby passing the partially assembled pallet onto the third leg 103 without changing the orientation thereof relative to the loop 100.

The ability of each of the pallet flipping mechanism 130 and the pallet rotating mechanism 140 to selectively reorient or bypass the partially assembled pallet allows for the partially assembled pallet to be reoriented to any of the four different orientations of the partially assembled pallet necessary for completing each of the possible process steps explained hereinafter. Specifically, the partially assembled pallet may be placed in the top deck up or the bottom deck up orientations, and each of these orientations may further include the reversal of the position of each of the opposing side surfaces of the partially assembled pallet.

The ability to reorient the partially assembled pallet in the manner described allows the partially assembled pallet to be selectively placed in whatever orientation is required for performing the next process step when completing the structure of the pallet. The partially assembled pallet can accordingly perform as many laps as necessary around the loop 100 with the partially assembled pallet being reoriented, as necessary, to assemble the components forming the pallet in the desired order. The use of such reorienting mechanisms beneficially reduces the number of components necessary for performing the process steps described hereinafter, as common components may be used for performing similar steps with respect to each of the opposing side surfaces of the partially assembled pallet. The majority of the components utilized for assembling the pallet can also be disposed along the first leg 101 and the second leg 102 of the loop 100 due to the manner in which these two legs 101, 102 can address two adjacent and perpendicular arranged side surfaces of the partially assembled pallet with respect to each lap thereof around the loop 100, thereby significantly reducing the footprint of the reassembly system 10 within a corresponding facility.

The pallet flipping mechanism 130 and the pallet rotating mechanism 140 are each shown as being configured to accept the partially assembled pallet with one of the long sides (48") of the partially assembled pallet in the leading position, but it should be understood that the mechanisms 130, 140 may alternatively be configured to accept the partially assembled pallets with one of the short sides (40") in the leading position, as desired, so long as the remaining components of the loop 100 are similarly reconfigured to address the contrary orientation of the partially assembled pallet.

The process steps capable of being carried out using the reassembly system 10 of FIG. 3 are described hereinafter following a description of the mechanisms utilized in carrying out the exemplary process steps. As explained in greater detail when describing further embodiments of the present invention, additional stations and mechanisms may be added to the reassembly system 10 in addition to those shown and described with reference to FIG. 3 for installing or replacing different components of the corresponding pallet. Additionally, as disclosed with reference to FIGS. 27-29, alternative configurations of the reassembly system 10 may be utilized in conjunction with the mechanisms and components described hereinafter without altering the methods of operation thereof.

FIGS. 10-13 illustrate a block installation mechanism 200 according to an embodiment of the present invention. The block installation mechanism 200 is configured for installing the peripherally disposed blocks BK1, BK2, BK3, BK4, BK5, BK6, BK7, BK8 into the partially assembled pallet. The block installation mechanism 200 includes a board spreader 202, a block pusher 230, and a block magazine 240. The block magazine 240 is securely coupled to a frame 201, wherein the frame 201 is fixed in position relative to the loop 100 of the reassembly system 10. At least one linear actuator 203 is configured to reciprocate the board spreader 202 rectilinearly relative to the stationary frame 201 and block magazine 240, wherein the reciprocating motion occurs in a horizontal direction arranged perpendicular to the direction of travel of the partially assembled pallet along the leg 101, 102, 103, 104 of the loop 100 having the corresponding block installation mechanism 200. Each of the linear actuators 203 may be a hydraulic or pneumatic linear actuator having a first end coupled to the stationary frame 201 and at an opposing second end coupled to the board spreader 202, as non-limiting examples. However, any actuator for causing rectilinear motion may be utilized, as desired, without departing from the scope of the present invention.

The board spreader 202 includes a substantially U-shaped guide structure 204 including a bottom wall 205 and a pair of sidewalls 206 extending upwardly from opposing sides of the bottom wall 205. The guide structure 204 defines a channel 207 having a rectangular cross-sectional shape corresponding to a cross-section of a block for use with the partially assembled pallet, wherein such a block is configured to slide within the channel 207 in a longitudinal direction thereof. An end portion 208 of the bottom wall 205 extends axially beyond an end 209 of each of the sidewalls 206 such that a block sliding through the channel 207 is partially exposed on its lateral sides when reaching the end portion 208.

A finger 210 is rotatably coupled to the guide structure 204 adjacent the end 209 of each of the sidewalls 206. Each of the fingers 210 is configured to rotate about a vertically extending axis arranged perpendicular to the direction of travel of the partially assembled pallet when traversing whatever leg 101, 102, 103, 104 of the loop 100 includes the block installation mechanism 200. The axis of rotation of each of the fingers 210 is also disposed laterally outwardly of the corresponding sidewall 206 of the guide structure 204 to cause each of the fingers 210 to rotate about an axis that is not disposed within the path of a block passing through the channel 207.

Each of the fingers 210 includes a substantially planar inner surface 211 extending from the corresponding axis of rotation to a distal end 212 of the corresponding finger 210. The planar surface 211 of each of the fingers 210 further includes a tapered tab 213 extending perpendicularly therefrom. Each of the tapered tabs 213 is substantially planar in configuration and is arranged substantially horizontally. Each of the tapered tabs 213 is tapered to have an increasing distance from the corresponding inner surface 211 as each of the tapered tabs 213 progresses in a direction towards the distal end 212 of the corresponding finger 210.

An upper surface 214 of each of the fingers 211 includes a first segment 215 extending from the respective axis of rotation thereof as well as a second segment 216 extending from the first segment 215 towards the distal end 212 of the corresponding finger 210. The first segment 215 may be disposed on a horizontally extending plane arranged parallel to a direction of reciprocation of the board spreader 202 relative to the frame 201 while the second segment 216 is tapered to include a decreasing height as the second segment 216 progresses away from the first segment 215 in a direction towards the distal end 212 of the corresponding finger 210. The first segment 215 of the upper surface 214 is disposed at a height above the bottom wall 205 with respect to the vertical direction that is greater than a height of any of the blocks suitable for use in reassembling one of the pallets. In contrast, the distal end 212 of the finger 210 includes a height that is smaller than the height of any of the blocks suitable for use in reassembling one of the pallets.

Each of the fingers 210 is spring-loaded to be normally urged to a configuration wherein the inner surface 211 of each of the fingers 210 is arranged at an acute angle relative to the direction of reciprocation of the board spreader 202 relative to the frame 201 to cause the distal end 212 of each of the fingers 210 to be disposed within the path of any blocks passing through the channel 207. Each of the fingers 210 further extends above the end portion 208 of the bottom wall 205 of the guide structure 204 when urged to the angled configuration, thereby causing the fingers 210 and the end portion 208 to form leading portions of the board spreader 202 when approaching a partially assembled pallet in need of one of the blocks. The spring loading of each of the fingers 210 may be accomplished with a suitable torsion spring associated with an axel or shaft forming the axis of rotation of each finger 210, as desired. However, it should be apparent that alternative spring loaded configurations may be utilized without necessarily departing from the scope of the present invention.

The block pusher 230 includes a contact element 232 and a linear actuator 234 configured to reciprocate the contact element 232 within the channel 207 of the board spreader 202. The contact element 232 includes a contact surface 233 arranged perpendicular to the direction of reciprocation of the contact element 232 within the channel 2007. The contact element 232 extends longitudinally in the direction of extension of the channel 207.

The linear actuator 234 is configured to reciprocate the contact element 232 between a fully extended position where the contact element 232 is pushing a block into position within a corresponding partially assembled pallet and a fully retracted position where the contact element 232 is retracted to a position for loading another block to be used in a subsequent block installation step. The contact element 232 includes a longitudinal dimension great enough to be partially disposed below the block magazine 240 even when placed in the fully extended position. In contrast, the entirety of the contact element 232 is not disposed under the block magazine 240 when the contact element 232 is in the fully retracted position, thereby allowing for one of the blocks to be gravity fed from the block magazine 240 for placement on the bottom wall 205 of the guide structure 204.

The block magazine 240 extends vertically above the channel 207 of the guide structure 204. The block magazine 240 includes at least one wall 241 defining an opening 242 having a cross-sectional shape substantially corresponding to a perimeter shape of each of the blocks stacked therein, thereby maintaining a desired orientation of each of the blocks prior to entry into the channel 207. A bottom surface 244 of the at least one wall 241 is disposed above the bottom wall 205 of the guide structure 204 at a height slightly greater than a height of the blocks stored within the magazine 240. As such, only one block is exposed for contact with the contact surface 233 of the contact element 232 at any one time. During operation of the block installation mechanism 200, the remainder of the blocks rest on either the block that is about to be pushed by the block pusher 230 following entry into the channel 207 or an upper surface 235 of the contact element 232 when the contact element 232 is not in the fully retracted position.

Figure 13:
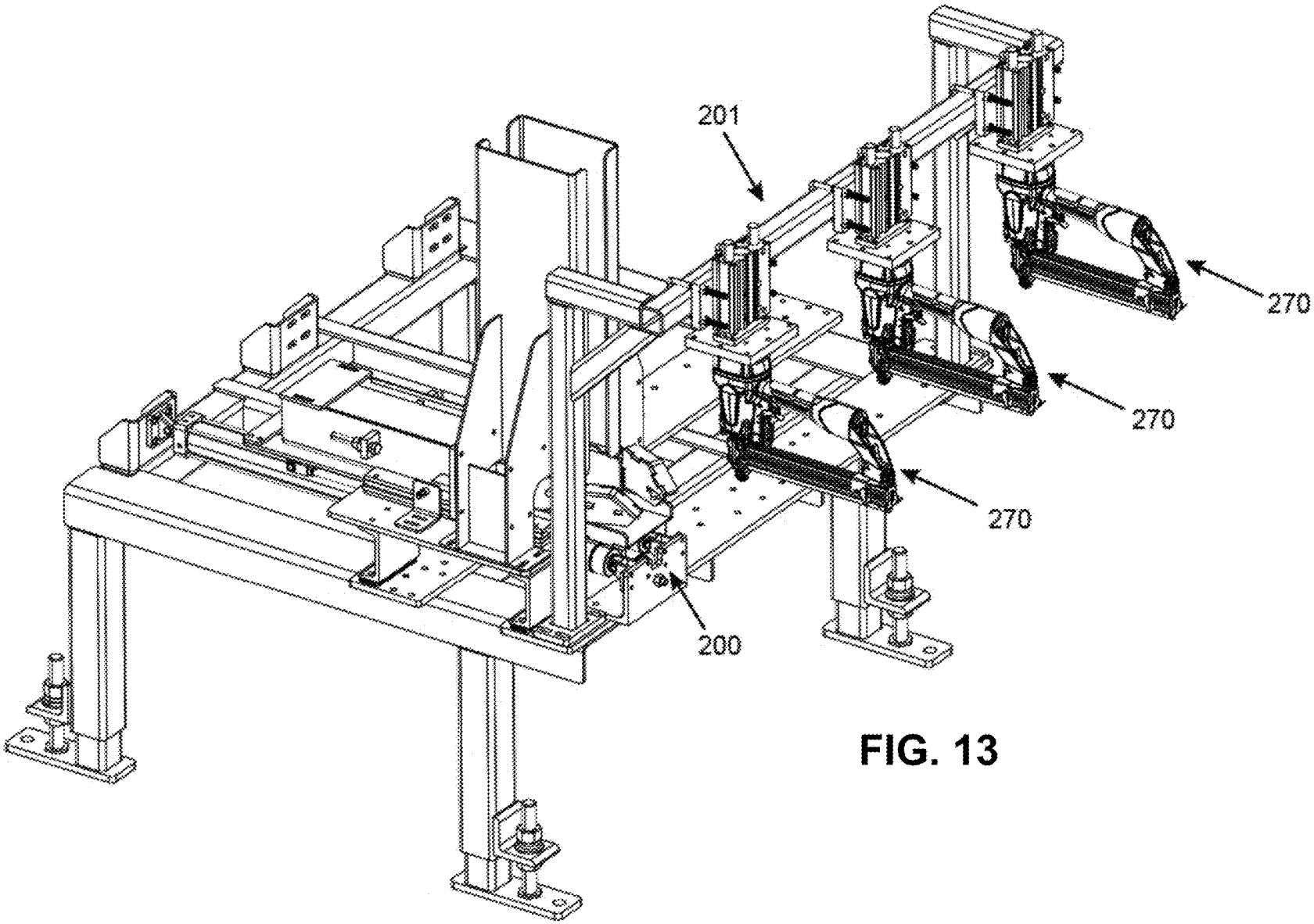

As shown in FIG. 13, each of the block installation mechanisms 200 of the reassembly system 10 is further associated with at least one staple gun 270. Each of the staple guns 270 is disposed vertically above a position of one of the blocks when installed into the desired position within the partially assembled pallet. Each of the staple guns 270 may be coupled to the frame 201. Each of the staple guns 270 is configured to reciprocate in the vertical direction between a retracted position wherein the corresponding staple gun 270 is disposed at a height above the partially assembled pallet and an extended position wherein the corresponding staple gun 270 extends downwardly to make contact with the partially assembled pallet for delivering a staple thereto. Each of the staple guns 270 is provided to couple the recently placed block to whatever board is disposed between the recently placed block and the corresponding staple gun 270 following the completion of the block installation, such as one of the bottom deck boards BB1, BB2, BB3, BB4, BB5 when the partially assembled pallet is in a bottom deck up orientation.

The embodiment of the block installation mechanism 200 shown and described herein is dimensioned for use with the elongate blocks BK1, BK2, BK3, BK5, BK6, BK7 forming the pallet, but it should be readily apparent to one skilled in the art that the block installation mechanism 200 may be easily adapted for the installation of the substantially square blocks BK4 and BK8, as desired. Such adaption may include re-dimensioning various components of the block installation mechanism 200, such as the cross-section of the block magazine 240, as necessary to operate in the same manner as described hereinafter.

Figure 14:
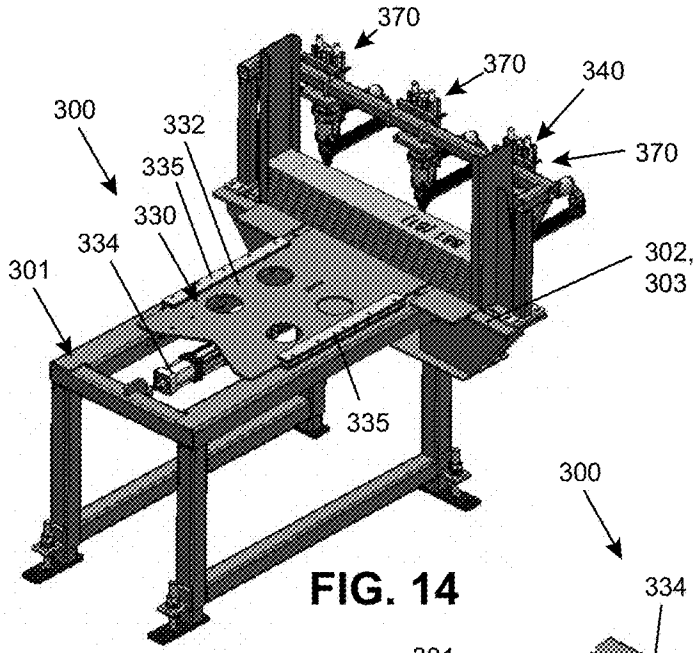
FIGS. 14 and 15 are perspective various views of a perimeter-board installation mechanism according to an embodiment of the present invention.
Figure 15:
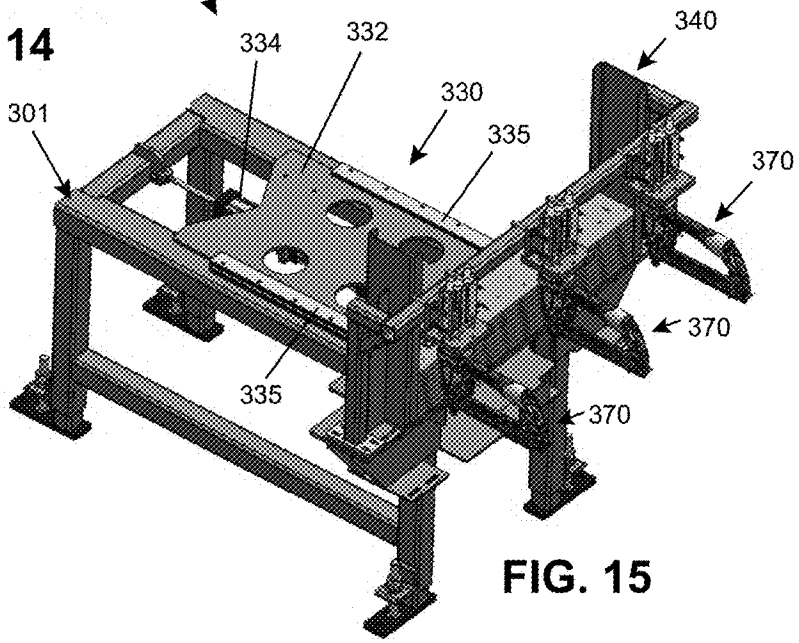

Referring now to FIGS. 14 and 15, a perimeter-board installation mechanism 300 is disclosed. The perimeter-board installation mechanism 300 is configured for installing those boards of the pallet formed extending along an exposed perimeter portion of the pallet, such as one of the short sides or one of the long sides thereof. For example, the perimeter-board installation mechanism 300 may be configured for installing any one of peripherally extending bottom deck boards BB1, BB2, BB3, BB4, BB5 or either of the leading top deck boards TB1 or TB9. In some circumstances, the perimeter-board installation mechanism 300 may also be suitable for installing the peripherally disposed stringers ST1 and ST3, as desired.

The perimeter-board installation mechanism 300 includes a stationary frame 301 to which a board pusher 330 and a board magazine 340 are coupled. The board magazine 340 is substantially similar to the block magazine 240 and operates in the same manner, wherein the boards are stacked in a desired configuration with only the bottommost one of the boards exposed beneath a bottom surface of whatever enclosure surrounds the stack of the boards. The board magazine 340 is oriented with the boards disposed therein arranged longitudinally in the direction of travel of the partially assembled pallet along the corresponding leg 101, 102, 103, 104 of the loop 100. The board magazine 340 is also positioned immediately adjacent the side surface of the partially assembled pallet in need of the installation of one of the boards. Specifically, the board magazine 340 is disposed on a platform 302 having a substantially planar and horizontally arranged upper surface 303.

The board pusher 330 includes an insertion plate 332 and a linear actuator 334. The insertion plate 332 is substantially planar in configuration and may include a height substantially similar to, but slightly smaller than, that of the boards being installed via the perimeter-board installation mechanism 300. The insertion plate 332 is arranged horizontally and may be configured to slide along rails 335 disposed on the frame 301 to each longitudinal side of the insertion plate 332. The linear actuator 334 is coupled at one end to the frame 301 and at another end to the insertion plate 332. The linear actuator 334 is configured to reciprocate the insertion plate 332 between a fully retracted position and a fully extended position. The insertion plate 332 is configured to slide over the upper surface 303 of the platform 302 when moving towards the fully extended position. The fully retracted position corresponds to a loading position wherein the insertion plate 332 is no longer disposed above the platform 302 and below the position of the board magazine 340, thereby allowing for the bottommost one of the boards disposed within the board magazine 340 to fall by gravity onto the upper surface 303 of the platform 302. The fully extended position includes the insertion plate 332 pushed to a maximum extent over the partially assembled pallet.

The fully extended position corresponds to an inspection mode of the perimeter-board installation mechanism 300. The insertion plate 332 is configured to pass over the uppermost exposed surface of the partially assembled pallet to determine if any nails, staples, debris, or other possible obstructions are present on the uppermost exposed surface. The uppermost exposed surface may be an uppermost surface of one of the peripherally disposed blocks BK1, BK2, BK3, BK5, BK6, BK7, BK8 or an uppermost surface of one of the stringers ST1, ST2, ST3. The board pusher 330 is configured to determine if the motion of the insertion plate 332 towards the partially assembled pallet is interrupted via such an obstruction. The linear actuator 334 may be associated with a force sensor configured to determine when a maximum force necessary for pushing the insertion plate 332 has been exceeded, wherein the detection of such a maximum force is indicative of an obstruction asserting a force against the insertion plate 332 in a direction opposing the motion thereof. The detection of such an obstruction may cause the controller to generate an alarm signal indicating that the board installation process step cannot be completed, and may further indicate to the reassembly system 10 that the instantaneously addressed partially assembled pallet must be removed from the loop 100 and addressed prior to reintroduction into the loop 100.

The insertion plate 332 is also configured to move to an installation position wherein the insertion plate 332 moves from the fully retracted position to a position wherein the corresponding board is pushed to a desired position within the partially assembled pallet. For example, the installation position may include the insertion plate 332 pushing one of the bottom deck boards BB1, BB2, BB3, BB4 onto some combination of the peripherally disposed blocks BK1, BK2, BK3, BK5, BK6, BK7, BK8 until an outer exposed surface of the corresponding deck board is flush with the adjacent outer exposed surfaces of the underlying blocks BK1, BK2, BK3, BK5, BK6, BK7, BK8 disposed along that side of the partially assembled pallet.

An array of staple guns 370 is also mounted to the frame 301 with the staple guns 370 disposed at positions above the partially assembled pallet corresponding to any intersections between the recently placed board, such as one of the bottom deck boards BB1, BB2, BB3, BB4, and the surface of any underlying components, such as some combination of the blocks BK1, BK2, BK3, BK5, BK6, BK7, BK8 supporting the bottom deck boards BB1, BB2, BB3, BB4. Each of the staple guns 370 is further configured to reciprocate in the vertical direction between a retracted position and an extended position in similar fashion to the staple gun 270. The retracted position includes the staple guns 370 moved upwardly to prevent the staple guns 370 from obstructing movement of the partially assembled pallet relative to the perimeter-board installation mechanism 300 while the extended position includes the staple guns 370 moving downwardly to initiate the insertion of a staple for coupling the underlying perimeter board to whatever components of the partially assembled pallet are supporting the perimeter board.

Figure 16:
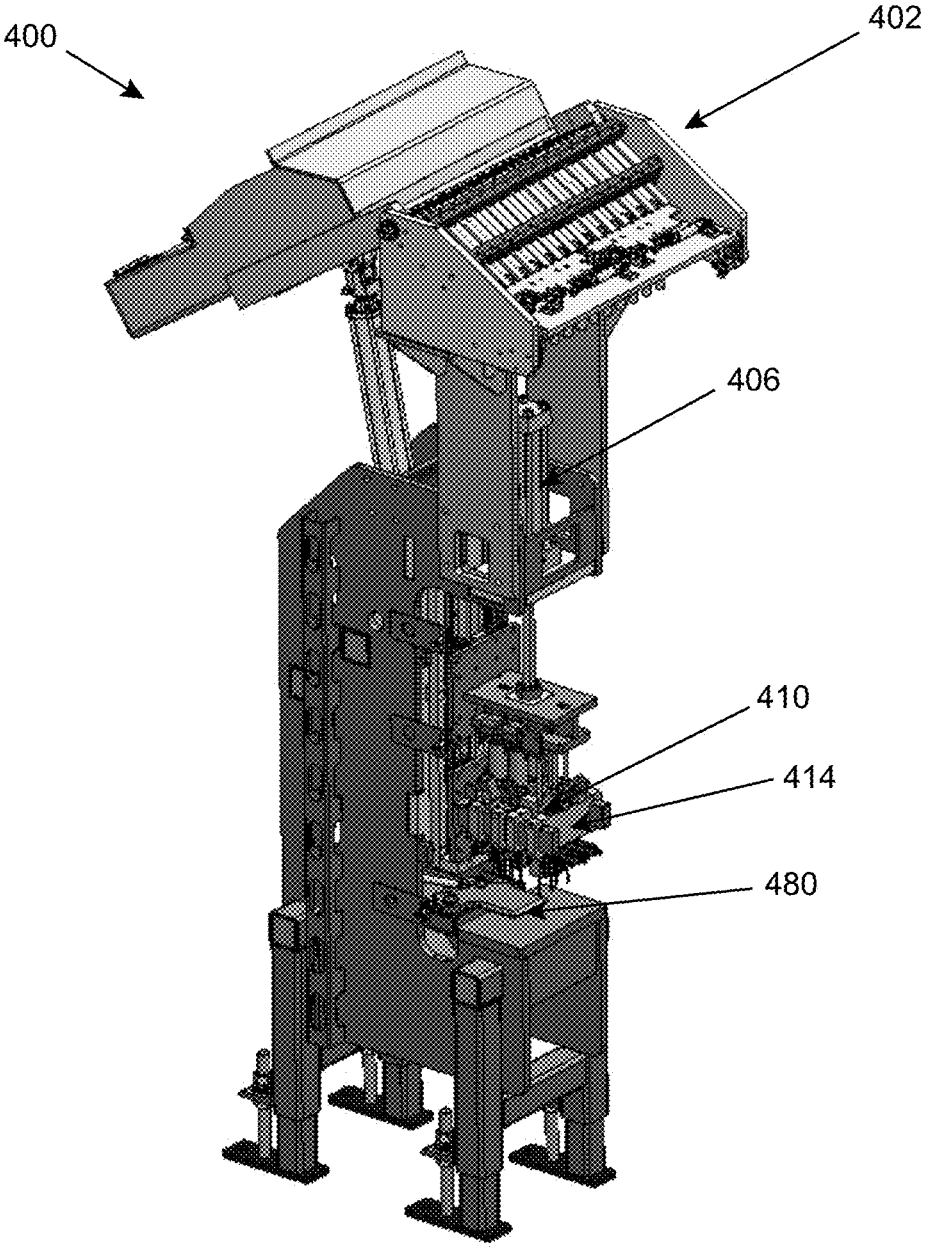
FIG. 16 is a perspective view of a nailing mechanism according to an embodiment of the present invention.

Referring now to FIG. 16, a nailing mechanism 400 is disclosed. The nailing mechanism 400 is configured to insert nails into adjoining components of the partially assembled pallet to securely couple the components to each other. As described herein, the nailing mechanism 400 is typically utilized for coupling those components together that have been recently installed and potentially stapled to one another for maintaining the relative positioning therebetween prior to the initiation of the nailing process. As such, the described staple guns 270, 370 may be utilized as temporary or partial coupling means that are subsequently supplemented by a downstream-arranged one of the nailing mechanisms 400 with respect to the direction of travel of the partially assembled pallet around the loop 100.

The nailing mechanism 400 includes a nail feeder 402, a press cylinder 406, a plurality of nail drive pins 410, and a plurality of nail chucks 414. The nail feeder 402 includes an actuated escapement (not shown) that selectively gravity feeds nails towards the respective nail chucks 414 via externally disposed tubes extending between the escapement and each of the nail chucks 414. The nail press cylinder 406 is configured to reciprocate the nail drive pins 410 and the nail chucks 414 between a retracted position wherein the nail drive pins 410 and the nail chucks 414 are disposed at a maximum height above the partially assembled pallet and an extended position utilized for driving nails into the partially assembled pallet.

Specifically, movement of the nail drive pins 410 and the nail chucks 414 towards the extended position includes the nail press cylinder 406 extending downwardly towards the nail chucks 414 and the nail drive pins 410 with respect to the vertical direction to force the nail chucks 414 and the nail drive pins 410 against the corresponding surface of the partially assembled pallet. Eventually the forces applied by the nail press cylinder 406 cause the nail drive pins 410 to force the nails into the adjoining components of the partially assembled pallet. A retraction of the nail press cylinder 406 towards the retracted position thereof pulls the nail drive pins 410 and the nail chucks 414 upwardly to prevent undesired interference with the partially assembled pallet when moving along the corresponding leg 101, 102, 103, 104 of the loop 100.

The nailing mechanism 400 also includes a bearing insert 480 configured to reciprocate in a horizontal direction arranged perpendicular to the direction of travel of the partially assembled pallet along the corresponding leg 101, 102, 103, 104 of the loop 100. The bearing insert 480 may be coupled to a horizontally extending linear drive actuator, as desired, for causing the horizontal reciprocation thereof. The bearing insert 480 is positioned vertically below the nail drive pins 410 and the nail chucks 414, and is configured for selective extension into the partially assembled pallet when a bottommost layer of the partially assembled pallet includes a gap or opening below the position at which the nails are being received into the partially assembled pallet. For example, if one of the bottom deck boards BB1, BB2, BB3, BB4 was recently installed into the partially assembled pallet while in a bottom deck up orientation, it is possible that one of the top deck boards TB1, TB2, TB3, TB4, TB5, TB6, TB7, TB8, TB9 forming a bottommost layer of the partially assembled pallet may be missing at a position in vertical alignment with the nailing mechanism 400. As such, the bearing insert 480 is extended horizontally into the corresponding gap present within the partially assembled pallet when the controller is aware that such a gap is present in the partially assembled pallet. The portions of the partially assembled pallet disposed between the nail chucks 414 and the spacing insert 480 are accordingly able to bear against the bearing insert 480 during the driving of the nails into the partially assembled pallet, thereby preventing damage to the intermediate layers of the partially assembled pallet.

Figure 17:
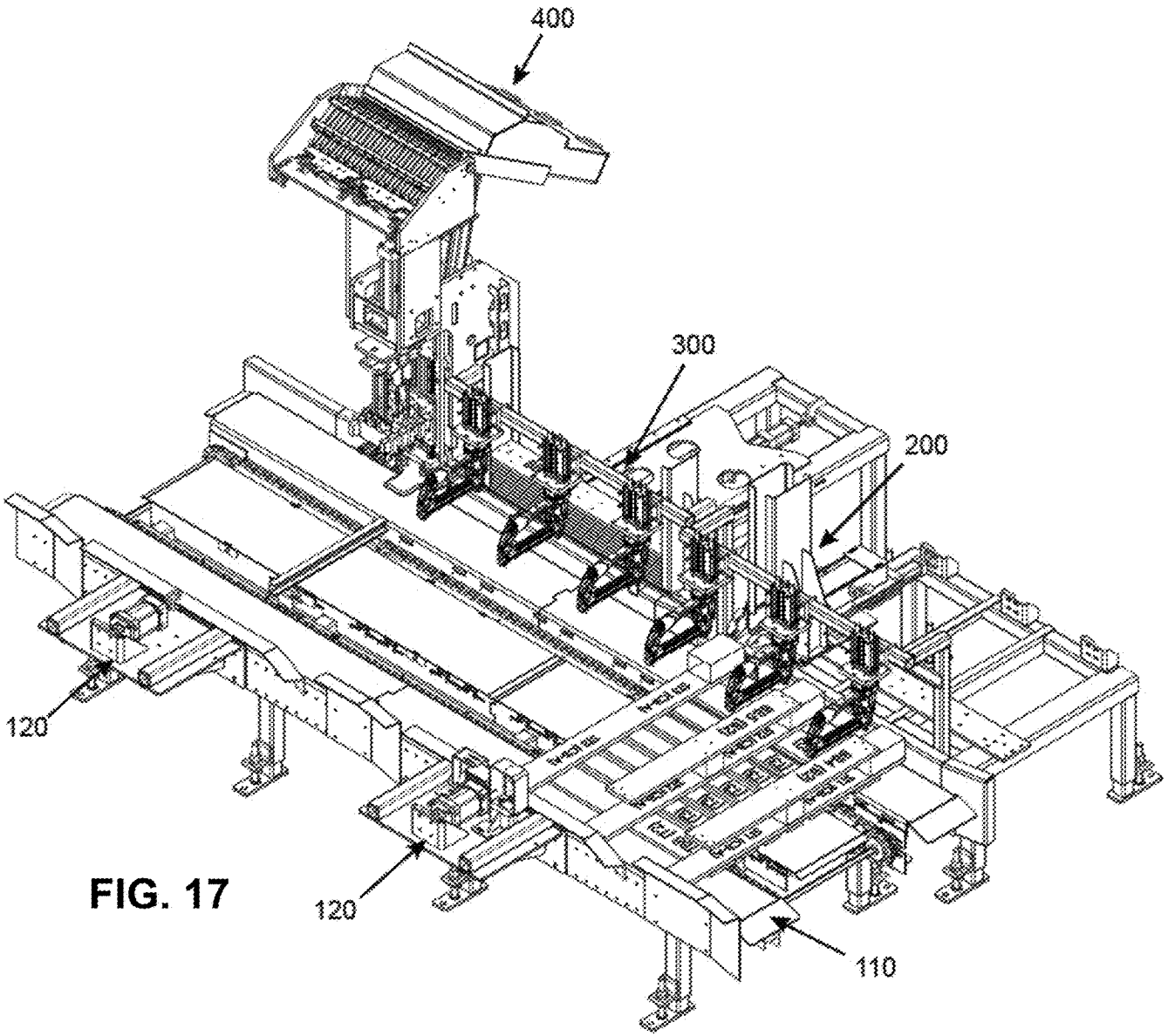
FIG. 17 is a perspective view showing a block installation mechanism, a perimeter-board installation mechanism, and a nailing mechanism relative to a conveyor assembly.

The method of operation of the reassembly system 10 and each of the corresponding mechanisms 200, 300, 400 occurs as follows. Each of the legs 101, 102, 103, 104 forming the loop 100 of the reassembly system 10 includes one of the drag chain conveyor assemblies 110 for advancing the partially assembled pallet in a direction of travel along the corresponding leg 101, 102, 103, 104. Each of the mechanisms 200, 300, 400 disposed along each of the legs 101, 102, 103, 104 is disposed at a suitable height, respectively, for the appropriate component of the partially assembled pallet to be either inserted into the partially assembled pallet or coupled to the remainder of the partially assembled pallet following the desired placement thereof. For example, each of the block installation mechanisms 200 may be positioned in the height direction such that the corresponding contact element 232 is vertically arranged at the same height of whatever gap within the partially assembled pallet is in need of one of the blocks. A positioning of each of the disclosed mechanisms 200, 300, 400 relative to one representative conveyor assembly 110 is disclosed in FIG. 17.

Each of the mechanisms 200, 300, 400 may also be associated with one of the sets of the position sensors 113 to allow the partially assembled pallet to be stopped in the direction of travel thereof at specified positions along the corresponding leg 101, 102, 103, 104 of the loop 100. Furthermore, each of the mechanisms 200, 300, 400 may also be associated with one of the pallet justification mechanisms 120 for ensuring that the partially assembled pallet is disposed at a desired angular orientation and a desired position with respect to a horizontal direction arranged perpendicular to the direction of travel of the partially assembled pallet along the corresponding leg 101, 102, 103, 104 of the loop 100. It is assumed hereinafter that the drag chain conveyor assembly 110 and the pallet justification mechanism 120 are used to properly position and orient the partially assembled pallet with respect to each of the described process steps, hence further mention of these steps is omitted herefrom when describing the different process steps achieved using the respective mechanisms 200, 300, 400.

The reassembly system 10 as shown in FIG. 3 includes the following mechanisms and components disposed around the loop 100, wherein each of the listed mechanisms and components is disposed around an exterior of the loop 100. Starting at the beginning of the first leg 101 at the lower-right corner of the illustration of the loop 100, the first leg 101 includes a first station 91. The first station 91 includes, in a direction of travel of the partially assembled pallet along the first leg 101, a block installation mechanism 200, a perimeter-board installation mechanism 300, another block installation mechanism 200, and a nailing mechanism 400. The second leg 102 includes, in a direction of travel of the partially assembled pallet along the second leg 102, a second station 92, a pallet flipping mechanism 130, and a third station 93. The second station 92 includes, in a direction of travel of the partially assembled pallet along the second leg 102, a block installation mechanism 200, a perimeter-board installation mechanism 300, and a nailing mechanism 400. The third station 93 includes, in a direction of travel of the partially assembled pallet along the second leg 102, a perimeter-board installation mechanism 300 and a nailing mechanism 400. A pallet rotating mechanism 140 is disposed at the junction of the second leg 102 and the third leg 103. The third leg 103 includes a third station 93 comprising a single nailing mechanism 400. The fourth leg 104 is devoid of any reassembly mechanisms, and is instead configured for transporting the partially assembled pallet back to the beginning of the first leg 101 for another lap around the loop 100. The downstream arranged block installation mechanism 200 of the first station 91 is configured for placing the square blocks BK4 and BK8, whereas all remaining block installation mechanisms 200 of the reassembly system 10 are configured for installing the elongated blocks BK1, BK2, BK3, BK5, BK6, BK7.

Figure 18:
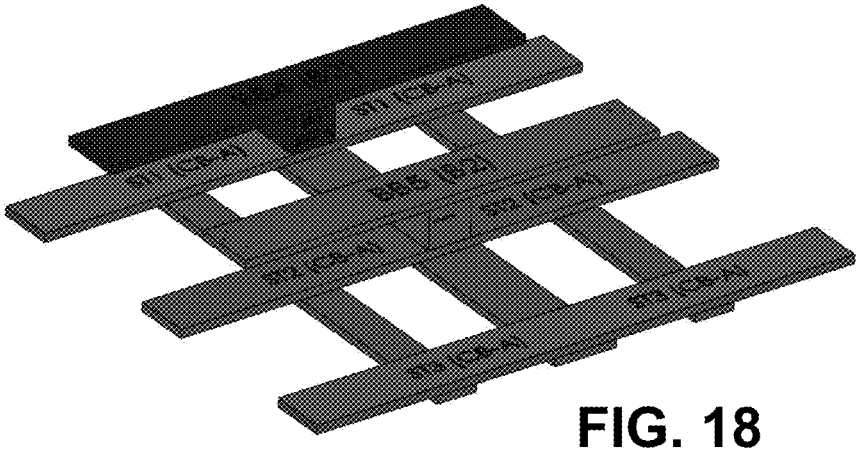
FIGS. 18-20 illustrate an exemplary pallet following various process steps configured to be carried out by the reassembly system of the present invention.
Figure 19:
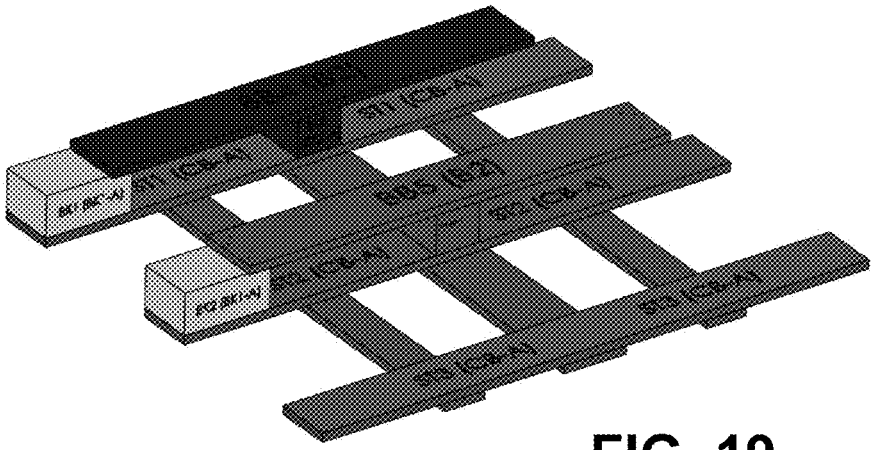
Figure 20:
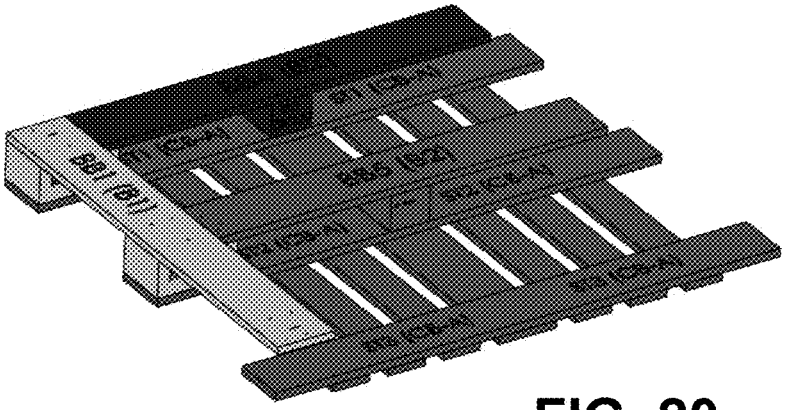

Referring now to FIGS. 18-20, progressive configurations of one of the pallets are shown with reference to exemplary process steps that may be accomplished with the disclosed mechanisms 200, 300, 400. The partially assembled pallet is introduced into the loop 100 having a top deck down and bottom deck up orientation with the pallet having the configuration shown in FIG. 18. The top deck includes only the top deck boards TB3, TB5, and TB7, the stringer layer includes all three stringers ST1, ST2, ST3, the block layer includes only blocks BK8 and BK9, and the bottom deck includes only bottom deck boards BB4 and BB5. A short side of the partially assembled pallet leads along the first leg 101. In the current example, no process steps are conducted along the first leg 101 during the first lap of the partially assembled pallet around the loop 100. Upon transferal to the second leg 102, a long side of the partially assembled pallet is leading with a corresponding short side thereof facing towards the mechanisms 200, 300, 400 of the second station 92.

First, the block BK2 is installed between the bottom deck board BB5 and the stringer ST2. The partially assembled pallet is advanced to a position wherein the extension direction of the board spreader 202 is aligned with the gap formed between the bottom deck board BB5 and the stringer ST1. The board spreader 202 is extended into this gap with the bottom wall 205 of the guide structure 204 disposed above the end portion of the stringer ST2. The fingers 210 of the board spreader 202 are also received into the gap with the tapered second segment 216 of the upper surface 214 of each of fingers 210 first encountering an outer and lower edge of the bottom deck board BB5. As the board spreader 202 is advanced into the gap, the tapering of the second segment 216 of the upper surface 214 causes the engaging portion of the bottom deck board BB5 to raise vertically until the engaging portion of the bottom deck board BB5 is spaced from the underlying stringer ST2 by a distance greater than a height of the block BK2. The engaging portion of the bottom deck board BB5 eventually comes to a rest on the horizontally extending first segment 215 of the upper surface 214 of each of the fingers 210.

Once the desired gap is formed in the partially assembled pallet, the block pusher 230 is actuated to cause the contact element 232 to move to the fully retracted position. This allows for one of the blocks BK2 stored within the corresponding block magazine 240 to drop into the channel 207 of the guide structure 204. The contact element 232 then moves towards the extended position thereof while pushing the block BK2 along the channel 207. Once the block BK2 reaches the end portion 208 of the bottom wall 205 the block BK2 begins to make contact with the angled inner surfaces 211 of the fingers 210. The continued motion of the block BK2 causes the fingers 210 to separate as they rotate laterally outwardly. Eventually, the tapered tabs 213 projecting from the inner surfaces 211 further push the fingers 210 outwardly until a lateral space between the inner surfaces 211 of the fingers 210 is greater than a width of the bottom deck board BB5 being supported by the fingers 210. The fingers 210 are configured to reach this open configuration at approximately the same time the block BK2 reaches the desired position within the gap present between the bottom deck board BB5 and the stringer ST2. The spreading of the fingers 210 thereby causes the bottom deck board BB5 to no longer be supported on the upper surface 214 of the fingers 210, thereby allowing the bottom deck board BB5 to drop into position on an upper disposed surface of the recently positioned block BK2.

At this time, the staple gun 270 positioned above the block BK2 is actuated to move vertically downwardly to install a staple through the upper disposed bottom deck board BB5 and the recently placed block BK2. The block BK2 is accordingly coupled to the bottom deck board BB5, thereby allowing for the retraction and withdrawal of the board spreader 202 from the space between the block BK2 and the underlying stringer ST2.

Following the installation and temporary coupling of the block BK2, the partially assembled pallet is advanced in the direction of travel until the gap present between the bottom deck board BB4 and the stringer ST1 is aligned with the block installation mechanism 200 for the installation of the block BK1. It should be understood that any of the blocks contained within the block magazine 240 may be able to be used interchangeably as any of the elongated blocks BK1, BK2, BK3, BK5, BK6, BK7, depending on the instantaneous process step. The installation of the block BK1 occurs relative to the bottom deck board BB4 and the stringer ST1 in the same manner as described with reference to the block BK2 relative to the bottom deck board BB5 and the stringer ST2, hence further description is omitted herefrom. The pallet is shown following the installation of the blocks BK1, BK2 in FIG. 19.

Following the insertion of the blocks BK1, BK2, the partially assembled pallet is advanced to a position adjacent the perimeter-board installation mechanism 300 of the second station 92 for installation of the bottom deck board BB1. First, the insertion plate 332 is moved to the fully extended position via the actuation of the linear actuator 334 while operating in an inspection mode. The insertion plate 332 passes over the uppermost surfaces of the blocks BK1 and BK2 to determine if any debris or fastener portions are obstructing the placement of the bottom deck board BB1. If the inspection discovers a concern, the installation of the bottom deck board BB1 is ceased and the partially assembled pallet is transported onward for additional maintenance, such as by removing the partially assembled pallet from the loop 100.

If the inspection reveals no obstructions, the insertion plate 332 is retracted away from the partially assembled pallet to the fully retracted position for loading the bottom deck board BB1 from the board magazine 340. In similar fashion to the block magazine 240, any of the boards disposed within the board magazine 340 may interchangeably represent any of the bottom deck boards BB1, BB2, BB3, BB4 in need of installation, depending on the instantaneous process step. The insertion plate 332 then pushes the bottom deck board BB1 along the platform 302 until the bottom deck board BB1 is resting on the blocks BK1 and BK2. Once so positioned, the staple guns 370 are extended downwardly to couple the bottom deck board BB1 to each of the blocks BK1 and BK2, respectively. A configuration of the pallet following the completion of this process is shown in FIG. 20.

Following the installation of the bottom deck board BB1 to achieve the configuration of FIG. 20, the partially assembled pallet is advanced until the block BK2 is disposed beneath the nailing mechanism 400 of the second station 92. In the current example, the leading top deck board TB1 is missing from the partially assembled pallet, hence the bearing spacer 480 of the nailing mechanism 400 must be extended into the corresponding gap within the partially assembled pallet beneath the stringer ST2. The nailing mechanism 400 is then actuated to drive the nails into the bottom deck board BB1 and the underlying block BK2. The partially assembled pallet is then advanced until the block BK1 is disposed beneath the nailing mechanism 400, wherein the same process is carried out to nail the bottom deck board BB1 to the block BK1.

The current example of the pallet reassembly process includes the partially assembled pallet being flipped at the pallet flipping mechanism 130 to place the partially assembled pallet in a bottom deck down and top deck up orientation. The partially assembled pallet then bypasses the third station 93 before being rotated 180 degrees within the pallet rotating mechanism 140. The flipping and rotation of the partially assembled pallet allows additional process steps to be performed on the next lap of the partially assembled pallet through the loop 100.

The remainder of the process steps required for assembled like components are omitted from description hereinafter, as each of the described process steps occurs in substantially the same manner as those process steps already described, wherein only the orientation of the partially assembled pallet and the specific blocks or boards in need of installation vary. As is clear from the accompanying figures, in many cases the partially assembled pallet must be reoriented (rotated or flipped) at an upstream position of a lap or during a prior lap around the loop 100 prior to the nails being delivered to the desired locations. This occurs because some components must be approached from a different vertical direction than is possible at the initial time of installation of the corresponding component. Although not described specifically, the leading top deck boards TB1 and TB9 are added to the partially assembled pallet in the same manner as the bottom deck boards BB1 and BB2, except the partially assembled pallet is in a flipped configuration in comparison to the orientation occurring during the installation of the bottom deck boards BB1 and BB2.

Figure 21:
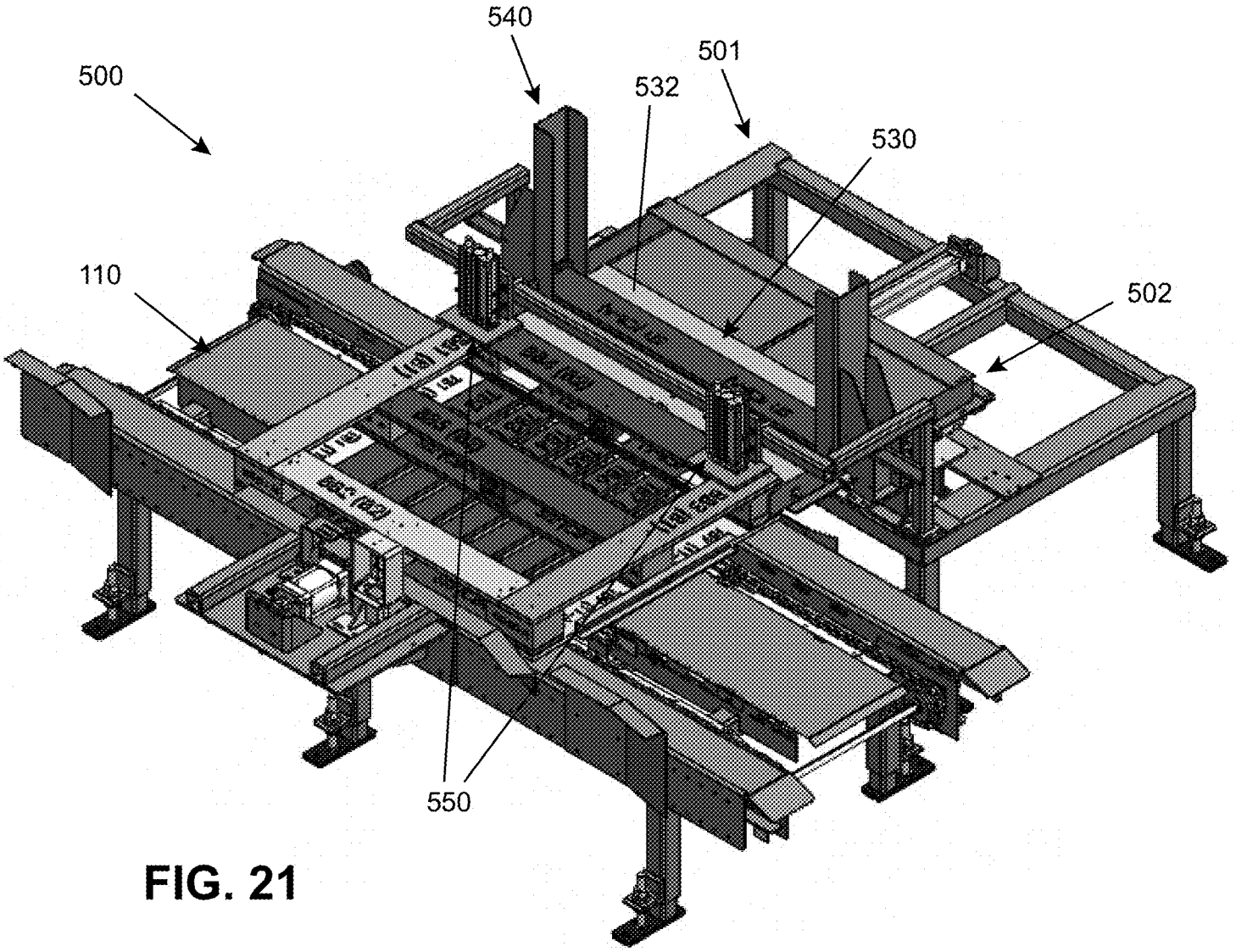
FIGS. 21-23 are perspective and elevational views of a stringer installation mechanism according to an embodiment of the present invention.
Figure 22:
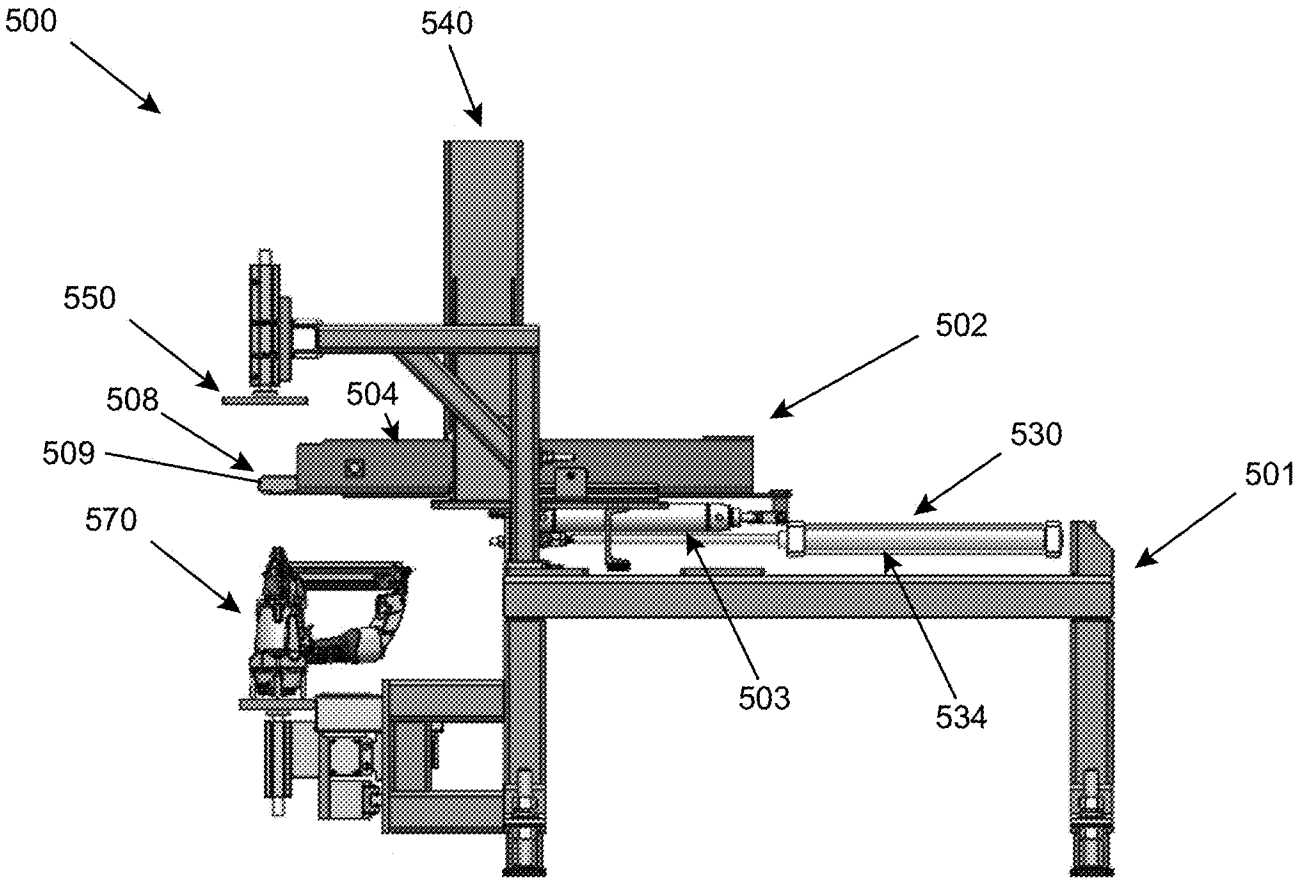
Figure 23:
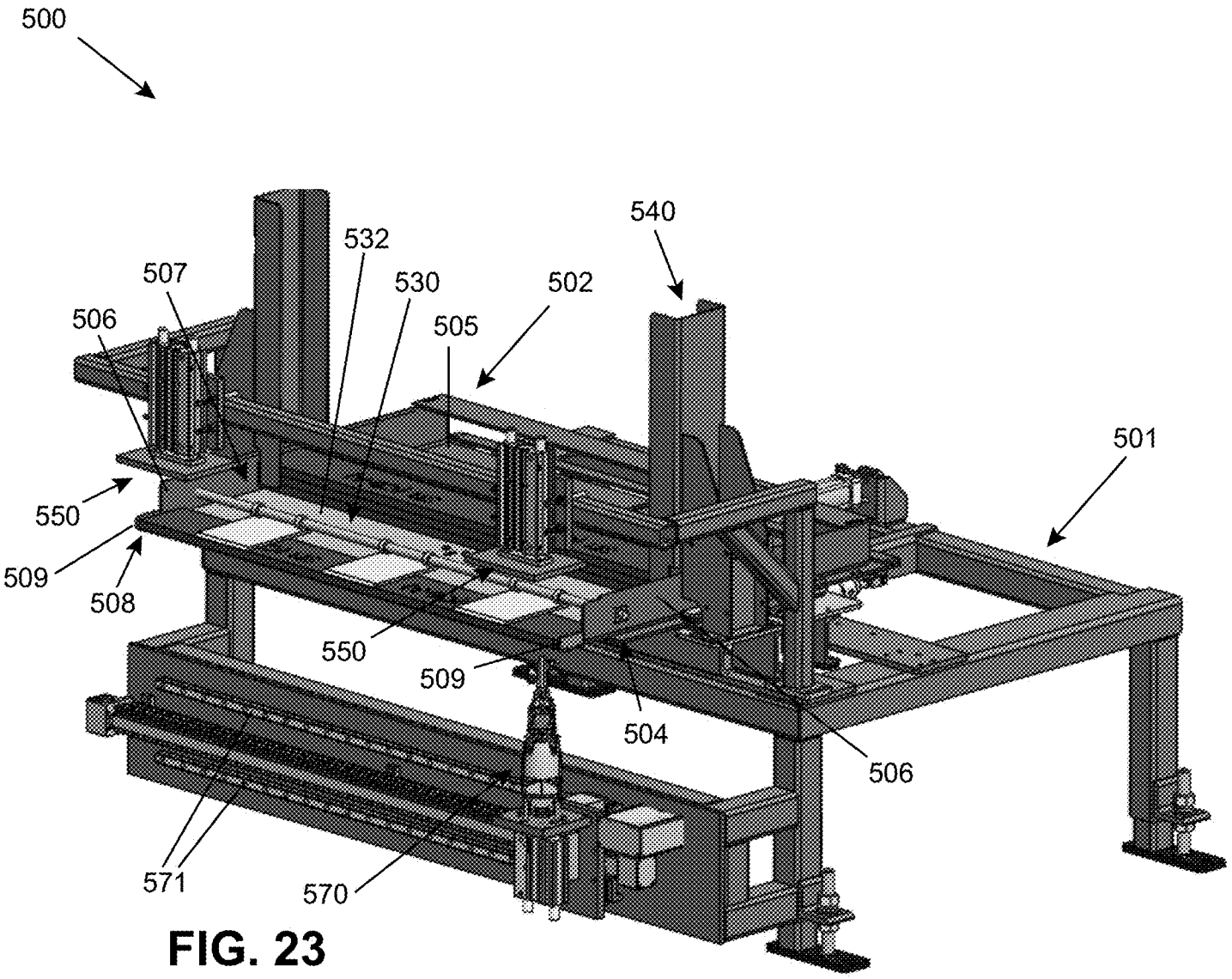

Referring now to FIGS. 21-23, a stringer installation mechanism 500 is disclosed according to an embodiment of the present invention. The stringer installation mechanism 500 includes features that are substantially similar to corresponding features found within each of the block installation mechanism 200 and the perimeter-board installation mechanism 300. The stringer installation mechanism 500 is configured for installing one of the peripherally disposed stringers ST1 or ST3 extending along one of the long sides of the partially assembled pallet. In the present embodiment, the direction of insertion of each of the stringers ST1 or ST3 results in the stringer installation mechanism 500 being suitable for installation along either of the first leg 101 or the third leg 103, each of which includes the long sides of the partially assembled pallet arranged substantially parallel to the direction of travel of the partially assembled pallet along the corresponding leg 101, 103. The stringer installation mechanism 500 is configured to install one of the stringers ST1, ST3 when the partially assembled pallet is in a top deck down orientation.

The stringer installation mechanism 500 includes a frame 501 supporting a board spreader 502, a board pusher 530, a board magazine 540, a pair of staple backups 550, and a translatable staple gun 570.

The board spreader 502 includes a substantially U-shaped guide structure 504 including a bottom wall 505 and a pair of sidewalls 506 extending upwardly from opposing sides of the bottom wall 505. The guide structure 504 defines a channel 507 having a rectangular cross-sectional shape configured to receive one of the stringers ST1, ST3 therein, wherein such a stringer ST1, ST2 is configured to slide within the channel 507 towards the partially assembled pallet during the installation process. An end portion 508 of the guide structure 504 includes the sidewalls 506 thereof having a reduced height that is slightly greater than a height of each of the stringers ST1, ST3 suitable for use with the stringer installation mechanism 500. An end 509 of each of the sidewalls 506 may include a slight taper to aid in piloting the end portion 508 of the guide structure 504 into a gap present within the partially assembled pallet between a corresponding block BK1, BK3, BK5, BK7 and a corresponding one of the top deck boards TB1, TB2, TB8, TB9. The end portion 508 of the guide structure 504 accordingly forms a gap suitable for reception of one of stringers ST1, ST3 therein.

At least one linear actuator 503 is configured to reciprocate the board spreader 502 rectilinearly relative to the stationary frame 501, wherein the reciprocating motion occurs in a horizontal direction arranged perpendicular to the direction of travel of the partially assembled pallet along the corresponding leg 101, 102, 103, 104 of the loop 100. Each of the linear actuators 503 may be a hydraulic or pneumatic linear actuator having a first end coupled to the stationary frame 501 and at an opposing second end coupled to the board spreader 502, as non-limiting examples. However, any actuator for causing rectilinear motion may be utilized, as desired, without departing from the scope of the present invention.

The board pusher 530 includes an insertion plate 532 and a linear actuator 534. The insertion plate 532 is substantially planar in configuration and may include a height substantially similar to, but slightly smaller than, that of the stringers ST1, ST3 being installed via the stringer installation mechanism 500. The insertion plate 532 is arranged horizontally and may be configured to slide within the guide structure 504. The linear actuator 534 is coupled at one end to the frame 501 and at another end to the insertion plate 532. The linear actuator 534 may be configured to reciprocate the insertion plate 532 between a fully retracted position and a fully extended position. The insertion plate 532 is configured to slide over the bottom wall 505 of the guide structure 504 when moving towards the fully extended position. The fully retracted position corresponds to a loading position wherein the insertion plate 532 is no longer disposed below the position of the board magazine 540, thereby allowing for the bottommost one of the stringers disposed within the board magazine 540 to fall by gravity into the channel 507 of the guide structure 504. The fully extended position may include the insertion plate 532 pushed to a maximum extent over the partially assembled pallet and may correspond to an inspection mode as described hereinabove. If the inspection mode is not utilized, the insertion plate 532 may instead be configured to reciprocate between the fully retracted loading position and an insertion position wherein the insertion plate 532 extends to a position corresponding to the placement of the associated stringer ST1, ST3 within the partially assembled pallet.

The board magazine 540 is disposed above the board spreader 502 and is configured to unload a board each time the insertion plate 532 is fully retracted. Otherwise, the remainder of the stringers stored within the board magazine 540 rest on top of the insertion plate 532 as it reciprocates back and forth.

The staple backups 550 are disposed above the partially assembled pallet and are spaced from each other with respect to the direction of travel of the partially assembled pallet. Each of the staple backups 550 provides a backing surface for the bottom deck of the partially assembled pallet to bear against during the installation of staples from one of the staple guns 570, which approach the partially assembled pallet from an underside thereof. The staple gun 570 is configured to translate along rails 571 extending horizontally in the direction of travel of the partially assembled pallet. The staple gun 570 may be coupled to a conveyor belt driven by a rotary actuator, wherein rotation of the rotary actuator in opposing rotary directions corresponds to the staple gun 570 translating in opposing directions relative to the direction of travel of the partially assemble pallet. However, any form of actuator and kinematics system may be utilized in causing the staple gun 570 to translate in the horizontal directions as described herein. The staple gun 570 may be further configured to actuate upwardly when inserting a staple through the corresponding stringer ST1, ST3 and any underlying top deck boards TB1, TB2, TB3, TB4, TB5, TB6, TB7, TB8, TB9.

In operation, the partially assembled pallet is advanced to a desired position relative to the stringer installation mechanism 500 such that the gap in the partially assembled pallet in need of the corresponding stringer ST1, ST3 is aligned with the channel 507 of the guide structure 504. The board spreader 502 is actuated to extend towards the partially assembled pallet with the end portion 508 thereof wedging into each of the gaps present between one of the top deck boards and each of the overlaying blocks, such as the gaps present between the leading top deck boards TB1, TB9 and each of the corner blocks BK1, BK3, BK5, BK7 disposed to the longitudinal side of the partially assembled pallet accepting the corresponding stringer ST1, ST3. The end portion 508 of the board spreader 502 increases the height of each of the gaps to be greater than a height of the corresponding stringer ST1, ST3 being installed therein.

The board pusher 530 retracts the insertion plate 532 thereof to load the corresponding stringer ST1, ST3 within the channel 507 in front of the insertion plate 532. The insertion plate 532 is actuated to an insertion position wherein the insertion plate 532 pushes the corresponding stringer ST1, ST3 into the heightened gaps until the corresponding stringer ST1, ST3 is flush with the adjacent components of the partially assembled pallet. The insertion plate 532 is then retracted from the insertion position. The staple gun 570 is configured to insert staples into the two corner positions of the partially assembled pallet to couple the corresponding stringer ST1, ST3 to the adjoining top deck board TB1, TB9, wherein the staple gun 570 is translated along the rails 571 between each staple insertion. The board spreader 502 can then retract from its position between the top deck layer and the block layer with the corresponding stringer ST1, ST3 maintaining its position due to the recent stapling step.

Figure 24:
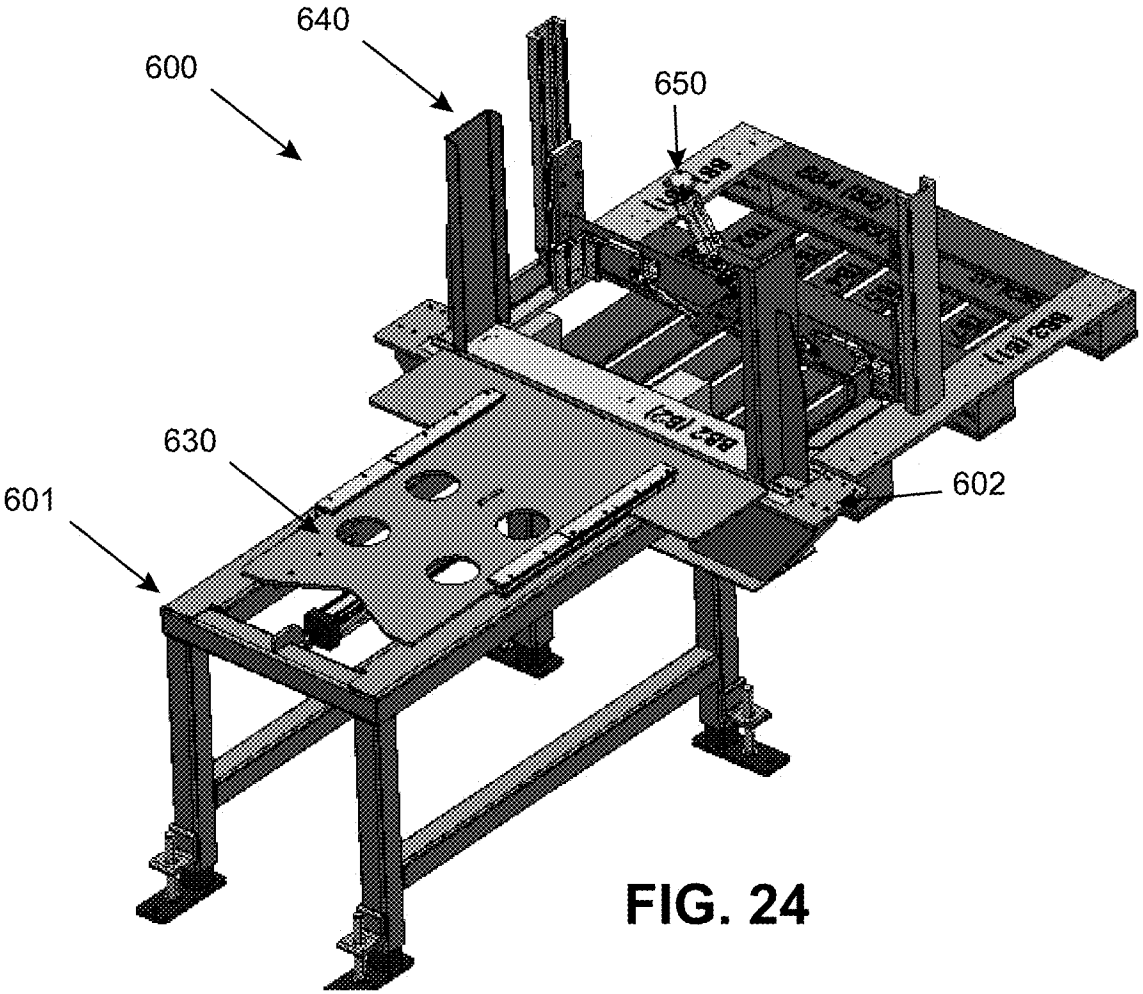
FIGS. 24 and 25 are perspective views of a modified perimeter-board installation mechanism according to an embodiment of the present invention.
Figure 25:
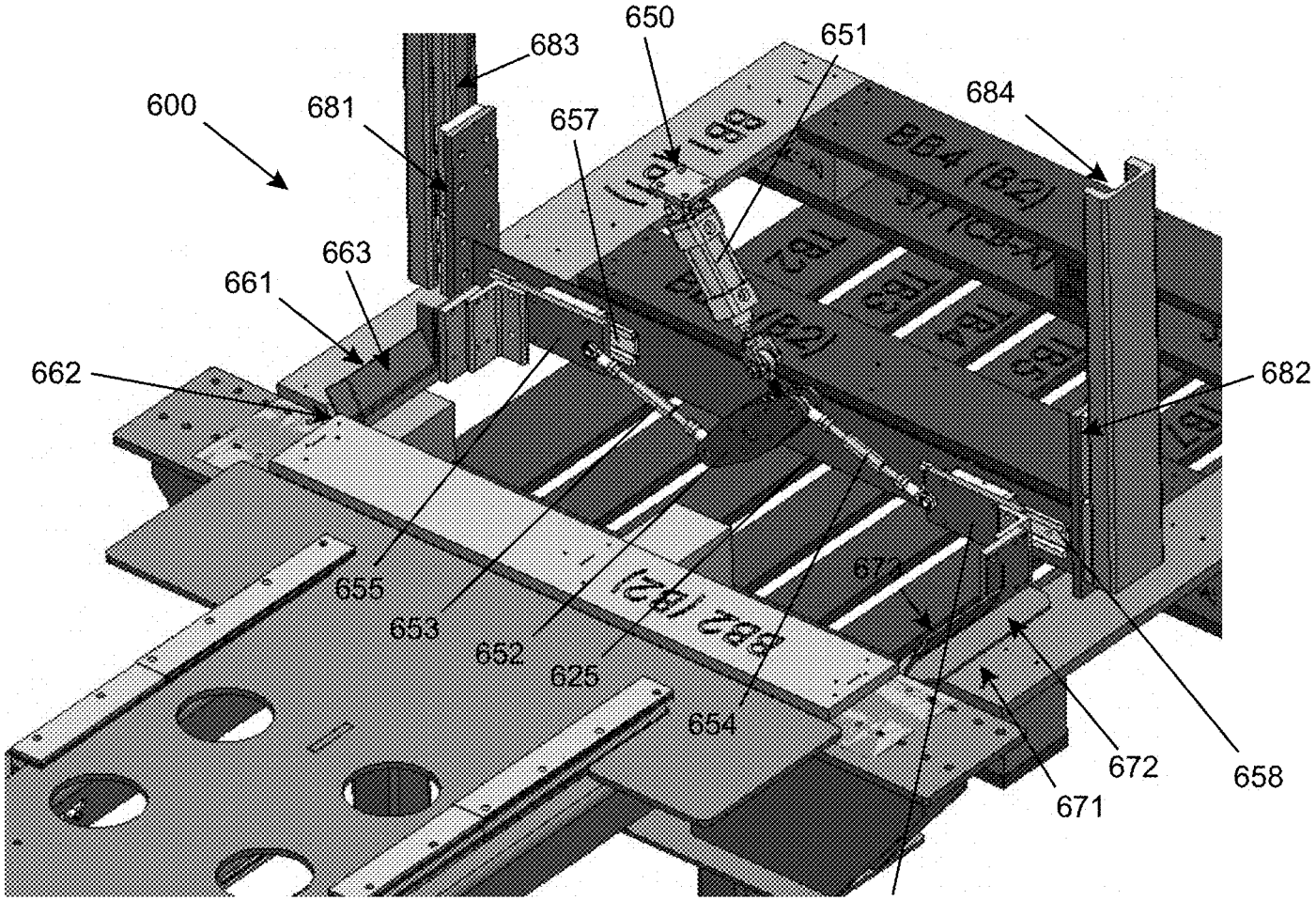

Referring now to FIGS. 24 and 25, a perimeter-board installation mechanism 600 according to another embodiment of the present invention is disclosed. The perimeter-board installation mechanism 600 is substantially similar in manner respects to the perimeter-board installation mechanism 300, and includes a frame 601, a platform 602, a board pusher 630, and a board magazine 640 that are structurally the same as the frame 301, the platform 302, the board pusher 230, and the board magazine 240 of the perimeter-board installation mechanism 300, hence further description is omitted herefrom. The perimeter-board installation mechanism 600 differs from the perimeter-board installation mechanism 300 by the addition of a pallet-centering device 650. The perimeter-board installation mechanism 600 is configured to perform the installation of only those bottom deck boards BB2, BB4 that are positioned along the longitudinal sides of the partially assembled pallet between the bottom deck boards BB1, BB3 extending along the short sides of the partially assembled pallet. The pallet-centering device 650 facilitates the desired positioning of the partially assembled pallet to receive the corresponding bottom deck board BB2, BB4 therein, and also aids in funneling the corresponding bottom deck board BB2, BB4 into the space present between the opposing bottom deck boards BB1, BB3.

The pallet-centering device 650 is configured to hang over the partially assembled pallet at a position perpendicular to the direction of travel thereof that corresponds to one of the gaps present to either side of the centrally disposed bottom deck board BB5. Although not pictured, the pallet-centering device 650 may depend downwardly from an overhead portion of the frame 601. An actuator 651 of the pallet-centering device 650 is coupled to and depends downwardly from the overhead portion of the frame 601. The actuator 651 is coupled to a center pivot element 652. The center pivot element 652 may be pivotally coupled to a cross bar 625 of the pallet-centering device 650 extending in the direction of travel of the partially assembled pallet, wherein an axis of rotation of the center pivot element 652 is centrally located thereon and extends perpendicular to the direction of travel of the partially assembled pallet. A first end of the center pivot element 652 is pivotally coupled to a first end of a first link 653 and an opposing second end of the center pivot element 652 is pivotally coupled to a first end of a second link 654. The actuator 651 may also be coupled to the center pivot element 652 adjacent the second end thereof. A second end of the first link 653 is pivotally coupled to a first carriage 655 and a second end of the second link 654 is pivotally coupled to a second carriage 656. The first carriage 655 is configured to slide along a first rail 657 and the second carriage 656 is configured to slide along a second rail 658. The first rail 657 and the second rail 658 are each coupled to the cross bar 625 and each similarly extend in the direction of travel of the partially assembled pallet.

The first carriage 655 is coupled to a first funnel element 661 extending perpendicular to the direction of travel of the partially assembled pallet. The first funnel element 661 includes an engaging portion 662 configured to engage one of the corresponding bottom deck boards BB1, BB3 and a funnel portion 663 configured to funnel the corresponding bottom deck board BB2, BB4 to the desired position within the partially assembled pallet. The engaging portion 662 may form a right-angled interior corner configured to engage perpendicular arranged surfaces of the corresponding bottom deck board BB1, BB3. The funnel portion 663 includes a substantially planar surface arranged at an angle relative to a horizontal plane with the planar surface angled to cause a corresponding bottom deck board BB2, BB4 to slide by gravity away from the one of the surrounding bottom deck boards BB1, BB3.

The second carriage 656 is coupled to a second funnel element 671 extending perpendicular to the direction of travel of the partially assembled pallet. The second funnel element 671 includes an engaging portion 672 configured to engage one of the corresponding bottom deck boards BB1, BB3 and a funnel portion 673 configured to funnel the corresponding bottom deck board BB2, BB4 to the desired position within the partially assembled pallet. The engaging portion 672 may form a right-angled interior corner configured to engage perpendicular arranged surfaces of the corresponding bottom deck board BB1, BB3. The funnel portion 673 includes a substantially planar surface arranged at an angle relative to a horizontal plane with the planar surface angled to cause a corresponding bottom deck board BB2, BB4 to slide by gravity away from the one of the surrounding bottom deck boards BB1, BB3.

A first end of the cross bar 625 includes a first sliding element 681 and an opposing second end of the cross bar 625 includes a second sliding element 682. The first sliding element 681 and the second sliding element 682 each extend longitudinally in the vertical direction. The first sliding element 681 is slidably coupled to a first rail 683 depending from the overhead portion of the frame 601 and the second sliding element 682 is slidably coupled to a second rail 684 also depending from the overhead portion of the frame 601. An actuator (not shown) is configured to cause the entirety of the cross bar 625 and each of the components coupled thereto to reciprocate in the vertical direction between a retracted (upward) position and an extended (downward) position. The retracted position corresponds to the pallet-centering device 650 being raised to prevent interference with one of the partially assembled pallets passing thereby while the extended position corresponds to the position of the pallet-centering device 650 when performing the installation of one of the bottom deck boards BB2, BB4.

In operation, the partially assembled pallet is advanced until the pallet-centering device 650 is disposed over the gap formed within the partially assembled pallet and configured for receiving the corresponding one of the bottom deck boards BB2, BB4. The actuator 651 is configured to pivot the center pivot element 652 about its axis of rotation in response to an extension or retraction of the actuator 651, which is coupled towards the second end of the center pivot element 652. The links 653, 654 have equal lengths to cause any rotation of the center pivot element 652 to be distributed equally to each of the carriages 655, 656 in the form of linear translation such that the carriages 655, 656 move equal distances away from or towards the center pivot element 652 depending on the direction of rotation thereof. As can be seen in FIG. 72, when the center pivot element 652 is actuated to a substantially vertical orientation the opposing carriages 655, 656 are pulled inwardly towards the center pivot element 652 and when the center pivot element 652 is actuated to a substantially horizontal orientation the opposing carriages 655, 656 are instead pushed outwardly away from the center pivot element 652.

The actuator 651 may initially actuate the center pivot element 652 towards the vertical orientation to ensure that a distance present between the opposing funnel elements 661, 671 is small enough to fit the funnel elements 661, 671 within the gap present between the opposing bottom deck boards BB1, BB3. The cross bar 625 is lowered via the interaction between the sliding elements 681, 682 and the corresponding rails 683, 684 until the engaging portions 662, 672 of the funnel elements 661, 671 rest on the respective bottom deck boards BB1, BB3. The actuator 651 is then actuated to rotate the center pivot element 652 towards the horizontal orientation to widen the spacing present between the opposing funnel elements 661, 671. The manner in which the funnel elements 661, 671 move equal distances from the axis of rotation of the center pivot element 652 causes the partially assembled pallet to be centered relative to the pallet-centering device 650 and the perimeter-board installation mechanism 600 once each of the vertically arranged surfaces of the engaging portions 662, 672 contact the respective bottom deck boards BB1, BB3. The centering of the partially assembled pallet may include the partially assembled pallet moving in the direction of travel away from the corresponding push bar 118 of the conveyor assembly 110. The funnel portions 663, 673 of the funnel elements 661, 671 are also positioned for aiding in guiding the corresponding bottom deck board BB2, BB4 to the desired position. The board pusher 630 then operates as described previously with respect to the board pusher 330 to place the corresponding bottom deck board BB2, BB4.

Figure 26:
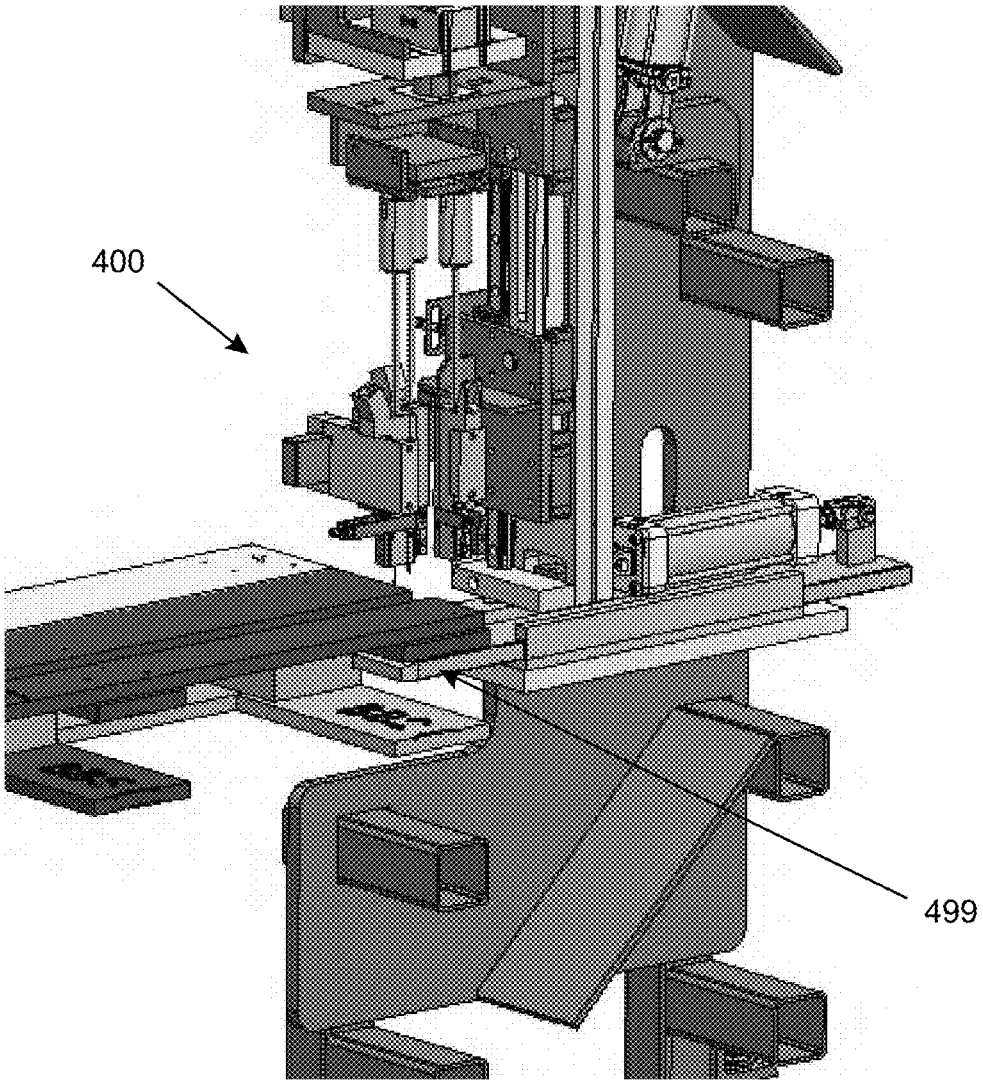
FIG. 26 is a perspective view of a clinch nailing mechanism according to an embodiment of the present invention.

FIG. 26 illustrates a modified nailing mechanism 400 configured for delivering shorter clinch nails at desired locations within the partially assembled pallet. The clinch nails may be desirable at certain joints rather than traditional nails. The clinch nails may be used to couple the top deck boards TB1, TB2, TB3, TB4, TB5, TB6, TB7, TB8, TB9 to the underlying stringers ST1, ST3. If a stringer ST1, ST3 was replaced, the clinch nails will be inserted at all relevant joints between the stringer ST1, ST3 and the adjoining top deck boards TB1, TB2, TB3, TB4, TB5, TB6, TB7, TB8, TB9. If a top deck board TB1, TB2, TB3, TB4, TB5, TB6, TB7, TB8, TB9 was replaced, only the joint formed between the recently replaced top deck board TB1, TB2, TB3, TB4, TB5, TB6, TB7, TB8, TB9 and the corresponding stringer ST1, ST3 will receive the clinch nails.

The nailing mechanism 400 includes a retractable anvil 499 that is configured to provide a back-stop at which any nails delivered by the nailing mechanism 400 are caused to stop and turn to form a bend in the nail with respect to the portion of the nail extending through the board or boards being nailed.

Either of the perimeter-board installation mechanisms 300, 600 disclosed herein may be adapted for the installation of the interior disposed top deck boards TB2, TB3, TB4, TB5, TB6, TB7, TB8. Each disclosed perimeter-board installation mechanism 300, 600 simply needs to be rotated about a vertical axis 90 degrees and repositioned over the pathway of the partially assembled pallet when traversing a leg 101, 102, 103, 104 of the loop 100 such that the top deck boards TB2, TB3, TB4, TB5, TB6, TB7, TB8 can be received at the proper positions within the partially assembled pallet with respect to the horizontal direction perpendicular to the direction of travel of the partially assembled pallet. Each respective board pusher 330, 630 would be configured to push each successive top deck board TB2, TB3, TB4, TB5, TB6, TB7, TB8 stored within the corresponding board magazine 340, 640 into position within the top deck layer as the partially assembled pallet is advanced to each necessary position.

Figure 27:
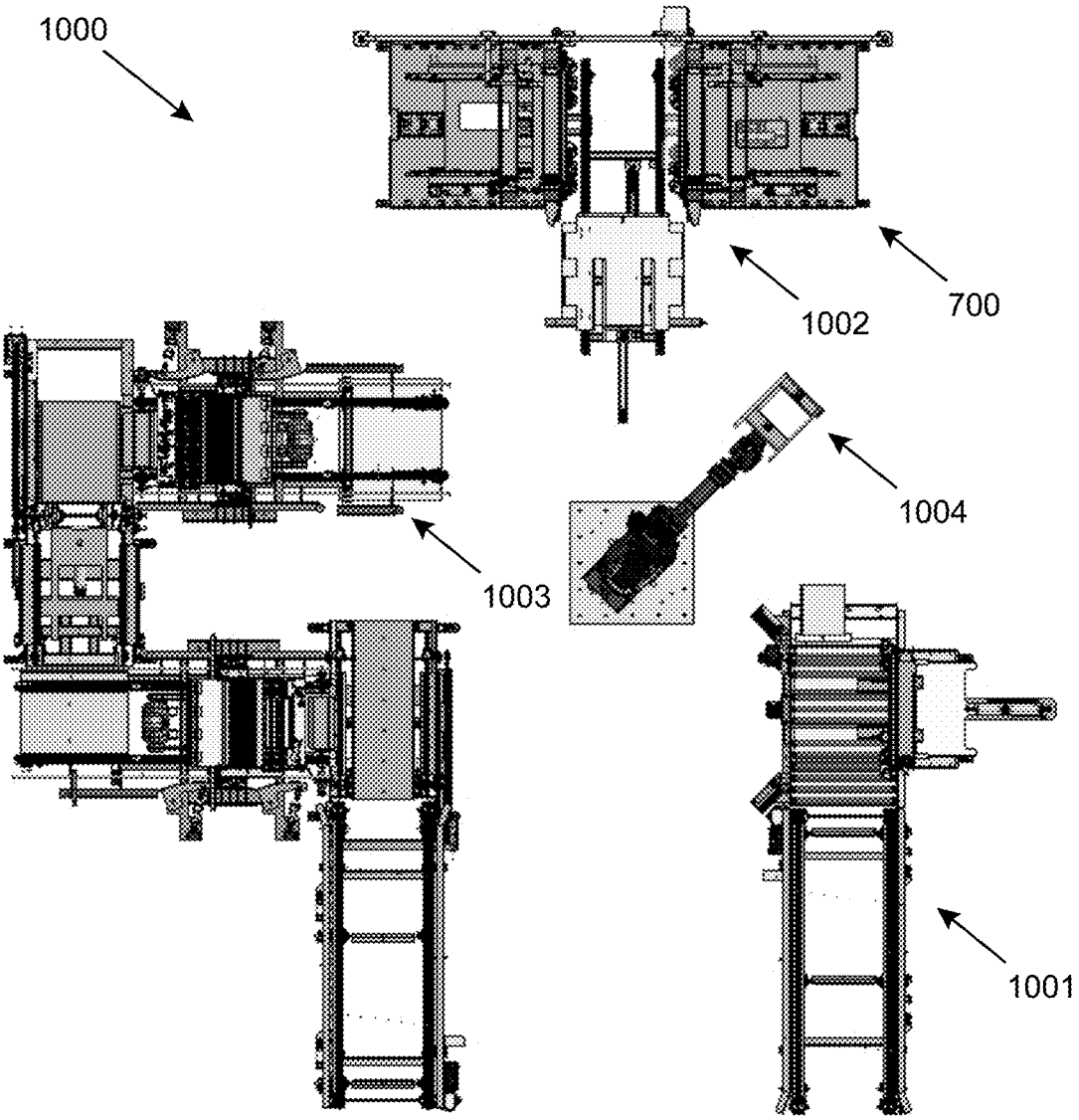
FIG. 27 is a top plan view of a pallet reassembly system having a multi-axis robot and a plurality of stations according to another embodiment of the present invention.

Referring now to FIG. 27, an alternative embodiment of the reassembly system as denoted by reference numeral 1000 is disclosed. The reassembly system 1000 may include substantially the same mechanisms and methods of operation as the previously disclosed loop 100 except where noted otherwise hereinafter. The reassembly system 1000 differs from the reassembly system 10 primarily in the arrangement of the mechanisms thereof, such as any combination of the mechanisms 200, 300, 400, 500, 600 disclosed herein or modifications thereof, and the manner in which the pallets are transported and reoriented between subsequent steps.

The reassembly system 1000 includes a first station 1001, a second station 1002, a third station 1003, and a multi-axis robot 1004 positioned within reach of each of the stations 1001, 1002, 1003. The multi-axis robot 1004 is configured to selectively grasp or otherwise retain each of the pallets for repositioning and/or reorienting the pallets when moving the pallets between the different stations 1001, 1002, 1003. The use of the multi-axis robot 1004 accordingly eliminates the need for multiple different transport mechanisms and rotating/flipping mechanisms between adjacent steps of the process, and can reduce time by prescribing the desired position and orientation of each of the pallets without requiring unnecessary loops through the reassembly system for achieving a desired position/orientation.

The reassembly system 1000 may include any number of the stations, and is not limited to the configuration of the illustrated stations 1001, 1002, 1003. Each of the stations utilized may also include any combination of the mechanisms 200, 300, 400, 500, 600 described hereinabove, as well as modifications thereof for interacting with the remainder of the reassembly system 1000 including the multi-axis robot 1004. However, the general processes regarding the insertion of certain boards of blocks of the pallet remain the same as described with reference to the mechanisms 200, 300, 400, 500, 600.

In the present example, the pallets may be first transported to the first station 1001 where the perimeter boards BB2 and BB4 may be optionally added to the pallet. The second station 1002 includes a modified perimeter-board installation mechanism assembly 700 (described in greater detail hereinafter) that may be configured to add any of the remaining perimeter boards BB1, BB3, TB1, or TB9 to the pallet. The third station 1003 may include the addition of any remaining boards or blocks not addressed by the first two stations 1001, 1002, as desired.

Figure 28:
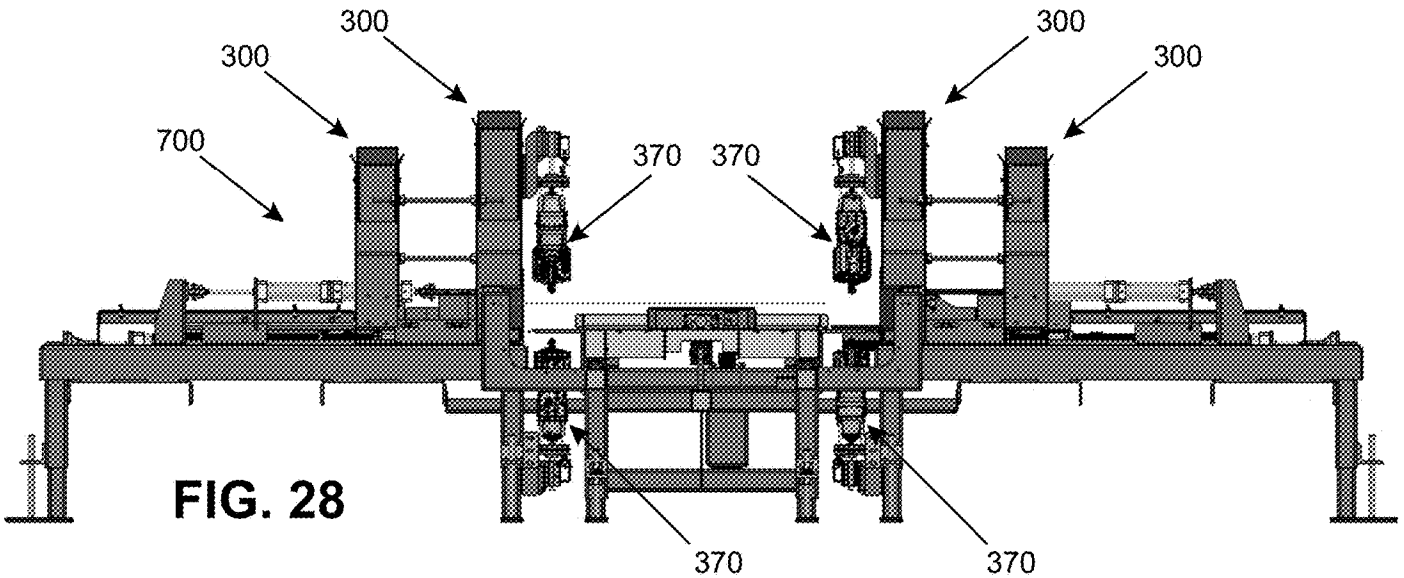
FIG. 28 is an elevational view of a perimeter-board installation mechanism assembly for installing multiple perimeter boards substantially contemporaneously.
Figure 29:
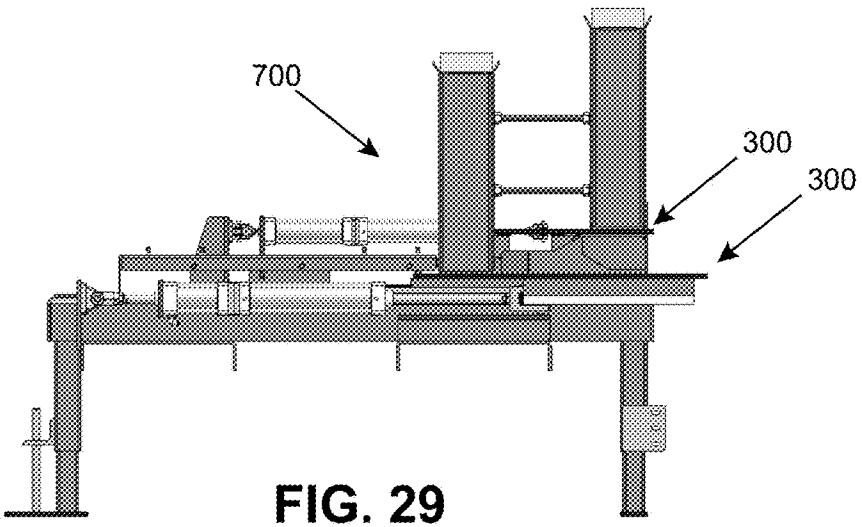
FIG. 29 is a cross-sectional view taken through one side portion of the perimeter-board installation mechanism assembly of FIG. 28.

The perimeter-board installation mechanism assembly 700 is shown its entirety in FIGS. 27 and 28. The assembly 700 includes the repetition of the structure associated with the perimeter-board installation mechanism 300 and the corresponding staple guns 370 thereof to each of the opposing sides of the pallet as well as above and below the pallet. That is, a first combination 300, 370 approaches the pallet from above at a first height and from a first side of the pallet, a second combination 300, 370 approaches the pallet from below at a second height from the first side of the pallet, a third combination 300, 370 approaches the pallet from above at the first height and from a second side of the pallet opposite the first side thereof, and a fourth combination 300, 370 approaches the pallet from below at the second height and from the second side of the pallet. The structure of two of the perimeter-board installation mechanisms 300 at the differing heights is illustrated in FIG. 29 to better illustrate the manner in which the boards delivered by the assembly 700 approach the pallet in the different ways described above.

The assembly 700 beneficially allows for the different perimeter boards described above to be added to the pallet with respect to four different locations on the pallet with respect to a single pass of the pallet through the assembly 700, which reduces the time and number of reorientations of the pallet necessary for replacing all such perimeter boards.

From the foregoing description, one ordinarily skilled in the art can easily ascertain the essential characteristics of this invention and, without departing from the spirit and scope thereof, can make various changes and modifications to the invention to adapt it to various usages and conditions.

What is claimed is:

1. A block installation mechanism configured for installing a block into a gap formed within a partially assembled block pallet, the gap formed between a first board of a first layer of boards of the partially assembled block pallet and a second board of a second layer of boards of the partially assembled block pallet, the block installation mechanism comprising:

a board spreader configured to reciprocate in a direction towards or away from the gap of the partially assembled block pallet, the board spreader including a guide structure including a bottom wall and a pair of sidewalls extending upwardly from opposing sides of the bottom wall, the guide structure defining a channel configured to slidably receive the block therein in the direction towards or away from the gap, wherein a finger is rotatably coupled to each of the sidewalls of the guide structure, wherein each of the fingers includes an upper surface having a tapered portion, wherein, during movement of the board spreader in the direction towards the gap, an engagement of the tapered portion of the upper surface of each of the fingers with the first board of the first layer of boards causes the height of the gap to increase to an increased height greater than a height of the block; and a block pusher configured to slidably push the block along the channel and into the gap when the gap is at the increased height and when the first board of the first layer of boards is engaging the upper surface of each of the respective fingers, wherein the block pusher includes a contact element configured to make direct contact with the block and a linear actuator configured to reciprocate the contact element within the channel of the board spreader, wherein a sliding of the block into the gap when at the increased height includes the block engaging an inner surface of each of the respective fingers to cause outward rotation of each of the respective fingers until a lateral space between the inner surfaces of the fingers is greater than a width of the first board, thereby disengaging the first board from the upper surface of each of the fingers to cause the first board to engage the installed block when resting on the second board of the second layer of boards.

2. The block installation mechanism of claim 1, wherein an end portion of the bottom wall extends axially beyond an end of each of the sidewalls, and wherein each respective finger is rotatably coupled to the guide structure adjacent the end of the corresponding sidewall thereof.

3. The block installation mechanism of claim 1, wherein each of the fingers is configured to rotate about a respective axis extending in the height direction of the gap.

4. The block installation mechanism of claim 1, wherein an axis of rotation of each respective finger is disposed laterally outwardly of the corresponding sidewall of the guide structure.

5. The block installation mechanism of claim 1, wherein an axis of rotation of each of the fingers is disposed outside of a path of the block when sliding through the channel in the direction towards the gap.

6. The block installation mechanism of claim 1, wherein the inner surface of each of the fingers includes a tapered tab extending transversely therefrom, wherein the block engages the tapered tab of each of the respective fingers when causing the outward rotation of each of the respective fingers.

7. The block installation mechanism of claim 6, wherein each of the tapered tabs is arranged on a plane transverse to an axis of rotation of each of the respective fingers.

8. The block installation mechanism of claim 6, wherein each of the tapered tabs is tapered to have an increasing distance from the inner surface of the corresponding finger as each of the tapered tabs progresses in a direction away from an axis of rotation of the corresponding finger.

9. The block installation mechanism of claim 1, wherein the upper surface of each of the fingers includes a first segment extending away from an axis of rotation of the corresponding finger and a second segment extending away from the corresponding first segment towards a distal end of the corresponding finger spaced apart from the corresponding axis of rotation thereof, wherein the second segment includes the tapered portion of the upper surface.

10. The block installation mechanism of claim 9, wherein the first segment of each of the upper surfaces is disposed on a plane arranged transverse to the axis of rotation of the corresponding finger, and wherein the second segment of each of the upper surfaces is tapered to include a decreasing height as the corresponding second segment progresses away from the first segment in a direction towards the distal end of the corresponding finger.

11. The block installation mechanism of claim 10, wherein, when the block is slidably disposed in the channel, an intersection of the first segment and the second segment of the upper surface of each of the fingers is disposed vertically above an upper surface of the block, and wherein a portion of the second segment of the upper surface of each of the fingers is disposed vertically below the upper surface of the block.

12. The block installation mechanism of claim 1, wherein each of the fingers is spring-loaded to be normally urged to a configuration wherein an inner surface of each of the fingers is arranged at an acute angle relative to the direction of reciprocation of the board spreader towards or away from the gap to cause a distal end of each of the fingers to be disposed within a path of the block when sliding through the channel towards the gap.

13. The block installation mechanism of claim 1, wherein each of the fingers is spring-loaded by a torsion spring coupled to an axel or shaft forming an axis of rotation of the corresponding finger.

14. A board installation mechanism configured to install a board into a partially assembly pallet, the board installation mechanism comprising:

a platform;

a board magazine disposed above the platform, the board magazine forming an enclosure having a board disposed therein and an open bottom end; and a board pusher including an insertion plate and a linear actuator, wherein the board rests on an upper surface of the insertion plate through the open bottom end thereof when the board is disposed within the board magazine, wherein the linear actuator is configured to reciprocate the insertion plate over an upper surface of the platform between a fully retracted position and a fully extended position, wherein the fully retracted position includes the insertion plate moved beyond a position of the board magazine to cause the board resting on the upper surface of the insertion plate while disposed within the board magazine to fall by gravity through the open bottom end of the enclosure onto the upper surface of the platform, and wherein reciprocation of the board pusher from the fully retracted position to the fully extended position includes the insertion plate pushing the board along the upper surface of the platform and over a portion of the partially assembled pallet.

15. The board installation mechanism of claim 14, wherein the linear actuator is associated with a force sensor configured to determine when a maximum force necessary for pushing the insertion plate has been exceeded when the insertion plate is reciprocated from the fully retracted position to the fully extended position and when the insertion plate extends over the portion of the partially assembled pallet.

16. The board installation mechanism of claim 15, wherein the detection of the maximum force being exceeded is indicative of an obstruction asserting a force against the insertion plate in a direction opposing the motion thereof when extending over the portion of the partially assembly pallet.

17. The board installation mechanism of claim 16, wherein an alarm signal is generated by the board installation mechanism when the force sensor determines the presence of the obstruction.

18. A pallet reassembly system configured for reassembling a partially assembled block pallet towards a fully assembled block pallet, the fully assembled block pallet including at least a first layer of boards, a second layer of boards spaced apart from the first layer of boards, and a layer of blocks disposed between the first layer of boards and the second layer of boards, the pallet reassembly system comprising:

a block installation mechanism configured to install one of the blocks into a gap formed within the partially assembled block pallet between one of the boards of the first layer and one of the boards of the second layer, the block installation mechanism including:

a board spreader configured to reciprocate in a direction towards or away from the gap of the partially assembled block pallet, the board spreader including a guide structure including a bottom wall and a pair of sidewalls extending upwardly from opposing sides of the bottom wall, the guide structure defining a channel configured to slidably receive the one of the blocks therein in the direction towards or away from the gap, wherein a finger is rotatably coupled to each of the sidewalls of the guide structure, wherein each of the fingers includes an upper surface having a tapered portion, wherein, during movement of the board spreader in the direction towards the gap, an engagement of the tapered portion of the upper surface of each of the fingers with the one of the boards of the first layer of boards causes the height of the gap to increase to an increased height greater than a height of the one of the blocks; and a block pusher configured to slidably push the one of the blocks along the channel and into the gap when the gap is at the increased height and when the one of the boards of the first layer of boards is engaging the upper surface of each of the respective fingers, wherein the block pusher includes a contact element configured to make direct contact with the one of the blocks and a linear actuator configured to reciprocate the contact element within the channel of the board spreader, wherein a sliding of the one of the blocks into the gap when at the increased height includes the one of the blocks engaging an inner surface of each of the respective fingers to cause outward rotation of each of the respective fingers until a lateral space between the inner surfaces of the fingers is greater than a width of the one of the boards of the first layer of boards, thereby disengaging the one of the boards of the first layer of boards from the upper surface of each of the fingers to cause the one of the boards of the first layer of boards to engage the installed one of the blocks when resting on the one of the boards of the second layer of boards; and a board installation mechanism configured to install one of the boards into one of the first layer of boards or the second layer of boards, the board installation mechanism including:

a platform;

a board magazine disposed above the platform, the board magazine forming an enclosure having the one of the boards disposed therein and an open bottom end; and a board pusher including an insertion plate and a linear actuator, wherein the one of the boards rests on an upper surface of the insertion plate through the open bottom end thereof when the one of the boards is disposed within the board magazine, wherein the linear actuator is configured to reciprocate the insertion plate over an upper surface of the platform between a fully retracted position and a fully extended position, wherein the fully retracted position includes the insertion plate moved beyond a position of the board magazine to cause the one of the boards resting on the upper surface of the insertion plate while disposed within the board magazine to fall by gravity through the open bottom end of the enclosure onto the upper surface of the platform, and wherein reciprocation of the board pusher from the fully retracted position to the fully extended position includes the insertion plate pushing the one of the boards along the upper surface of the platform and to a desired position within the first layer of boards.

19. The pallet reassembly system of claim 18, further comprising a conveyer assembly configured to transport the partially assembled block pallet between the block installation mechanism and the board installation mechanism.

* * * * *